US009962752B2

(12) United States Patent
Uchiyama et al.

(10) Patent No.: US 9,962,752 B2
(45) Date of Patent: May 8, 2018

(54) PRESS-FORMING METHOD

(71) Applicant: NIPPON STEEL & SUMITOMO METAL CORPORATION, Tokyo (JP)

(72) Inventors: Shigeru Uchiyama, Tokyo (JP); Yasuharu Tanaka, Tokyo (JP); Takashi Miyagi, Tokyo (JP); Misao Ogawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 392 days.

(21) Appl. No.: 14/758,172

(22) PCT Filed: Jan. 16, 2013

(86) PCT No.: PCT/JP2013/050692

§ 371 (c)(1),
(2) Date: Jun. 26, 2015

(87) PCT Pub. No.: WO2014/112056

PCT Pub. Date: Jul. 24, 2014

(65) Prior Publication Data

US 2015/0367397 A1 Dec. 24, 2015

(51) Int. Cl.

| | |
|---|---|
| ***B21D 22/21*** | (2006.01) |
| ***B21D 22/26*** | (2006.01) |
| ***B21D 53/88*** | (2006.01) |

(52) U.S. Cl.

CPC ..... *B21D 22/21* (2013.01); *B21D 22/26* (2013.01); *B21D 53/88* (2013.01)

(58) Field of Classification Search

CPC ..... B21D 22/21; B21D 22/26; B21D 53/88
See application file for complete search history.

(56) References Cited

U.S. PATENT DOCUMENTS

2005/0262917 A1 12/2005 Osumi et al.
2009/0049886 A1 2/2009 Okuzumi et al.
(Continued)

FOREIGN PATENT DOCUMENTS

CN 101372025 A 2/2009
CN 102791396 A 11/2012
(Continued)

OTHER PUBLICATIONS

International Search Report, issued in PCT/JP2013/050692, dated Apr. 23, 2013.

*Primary Examiner* — Teresa M Ekiert
(74) *Attorney, Agent, or Firm* — Birch, Stewart, Kolasch & Birch, LLP

(57) ABSTRACT

A press-forming method which press-forms a final shaped article which comprises a top sheet part, vertical wall parts, and flange parts and which has at least one bent part in a longitudinal direction, which method forms the top sheet part, vertical wall parts, bent part, and flange parts, includes a first shaping process of bending a flange part at an intersecting part until an angle of the flange part with a horizontal line becomes $\alpha_1$ in a plane which includes a horizontal line which connects an intersecting part of a vertical wall part and a flange part and a center of curvature of the bent part and which is vertical to the high strength steel sheet and a second shaping process of additionally bending the flange part after the first shaping process at the intersecting part until the angle of the flange part with the horizontal line becomes $\alpha_2$ in that plane, makes the additional bending angle $\beta$ of $\alpha_1$-$\alpha_2$ predetermined ranges, and thereby reduces the warping and torsion of the final shaped article.

4 Claims, 11 Drawing Sheets

(56) References Cited

U.S. PATENT DOCUMENTS

| | | | |
|---|---|---|---|
| 2012/0171506 | A1 | 7/2012 | Futatsuka et al. |
| 2012/0297853 | A1 | 11/2012 | Tanaka et al. |
| 2014/0182349 | A1 | 7/2014 | Yonemura et al. |

FOREIGN PATENT DOCUMENTS

| | | | |
|---|---|---|---|
| CN | 102574192 | B | 7/2015 |
| JP | 2004-188445 | A | 7/2004 |
| JP | 2006-15404 | A | 1/2006 |
| JP | 2008-23601 | A | 2/2008 |
| JP | 4751375 | B2 | 8/2011 |
| RU | 2057606 | C1 | 4/1996 |
| SU | 269137 | | 4/1970 |
| TW | 201302343 | A1 | 1/2013 |

(a)

(b)

PRESS-FORMING METHOD

TECHNICAL FIELD

The present invention relates to a press-forming method which shapes high strength steel sheet to a final shaped article which has a bent part in a longitudinal direction. In particular, the present invention relates to a press-forming method which suppresses warping and torsion of the final shaped article caused by residual stress.

BACKGROUND ART in recent years, from the viewpoint of improving fuel economy and enhancing the collision safety of automobiles, high strength steel sheet or aluminum alloy with a high tensile strength has come to be used for frame parts in particular. A high tensile strength material can improve the collision performance without increasing the sheet thickness of the material, so is useful for lightening the weight.

However, due to the higher strength of materials, the warping and torsion of a final shaped article caused by residual stress at the time of press-forming become larger and securing shape precision of the final shaped article becomes an issue.

When shape precision of a final shaped article cannot be secured, a gap is formed with other parts when assembling the article in a vehicle. If the amount of the gap is large, assembly problems result. Accordingly, strict shape precision is demanded from the final shaped article. Further, in the case of a part with a small curvature in a bent part of a final shaped article, that is, a radius of curvature of a bent part is 50 to 2000 mm, a high shape precision is particularly demanded. The shape of the bent part is an arc or a curve with a continuously changing curvature. If there are a plurality of such bent parts at the final shaped article, the warping and torsion in the longitudinal direction of the final shaped article which accompany planar stress of the final shaped article are large. For this reason, it is further difficult to secure precision of the final shaped article.

As a conventional general measure for countering poor shape precision, the method is adopted of using prototypes of the final shaped article or past experience to predict the amount of springback and finishing the shape of the die to a shape different from the shape of the final shaped article so as to satisfy the predetermined dimensions. Further, in recent years, before making prototypes of the final shaped article, springback and other aspects of the press-forming operation have been analyzed based on the final shape using the finite element method so as to make the die and thereby reduce the number of corrections to the die when making prototypes.

However, with designing a die based on trial and error, there was the problem that a long time is taken until devising a shape of a die which sufficiently reduces warping and torsion and until establishing shaping conditions. Further, since trial and error are used to design the die, the cost of die correction soars and therefore there was the problem of reduction of cost of the final shaped article being obstructed.

As a measure for improving the shape precision of the final shaped article, the art of imparting a bead to the final shaped article so as to suppress warping and torsion of the final shaped article (PLT 1) has been disclosed. Further, the art of using the holding surfaces of a die and blank holder to locally press against a blank to form a bead at the blank and thereby increase the tension of the vertical wall part so as to secure the shape precision of the final shaped article (PLT 2) has been disclosed.

The arts which are disclosed in PLT 1 and PLT 2 impart a bead to the final shaped article to improve the product shape to thereby suppress springback. Therefore, the shapes of the final shaped articles to which these can be applied are limited. There is the problem that the arts are not universally applicable.

PLT 3 discloses a press-forming method which improves the shape precision of a press-formed article which has a hat-shaped cross-section which comprises a top sheet part, vertical wall parts, and flange parts. The press-forming method which is described in PLT 3 press-forms a metal sheet into an intermediate shaped article which has tapered parts between the vertical wall parts and flange parts, then again press-forms the tapered parts and flange parts of the intermediate product to obtain the final shaped article.

However, the press-forming method which is disclosed in PLT 3 raises the precision of the angles between the vertical wall parts and the flange parts at the final shaped article and improves the flatness of the flange parts. It does not suppress warping or torsion of the final shaped article as a whole.

PLT 4 discloses a press-forming method which improves the shape precision of a final shaped article which comprises a top sheet part and vertical wall parts and which has a bent part. The press-forming method which is described in PLT 4 bends a metal sheet into an intermediate product which has bending angles of the top sheet part and vertical wall parts giving greater amounts of bending than the final shaped article, then bends it back to the bending angles of the final shaped article.

However, in the press-forming method of PLT 4, when the metal sheet is a soft steel sheet or other metal sheet with a tensile strength which is not that high, the warping or torsion of the final shaped article could be suppressed, but when a high strength steel sheet or other metal sheet with a high tensile strength, warping or torsion of the final shaped article cannot be suppressed. Further, when the final shaped article is provided with flange parts and has a cross-sectional shape of a hat shape, tensile stress easily remains at the flange part at the inside of the bent part, so there is the problem that the warping and torsion of the final shaped article become further larger.

CITATIONS LIST

Patent literature

PLT 1. Japanese Patent Publication No. 2004-25273A
PLT 2. Japanese Patent Publication No. 11-290951A
PLT 3. Japanese Patent Publication No. 2006-289480A
PLT 4. Japanese Patent Publication No. 2004-195535A

SUMMARY OF INVENTION

Technical Problem

The present invention has as its object the provision of a press-forming method which can reduce the warping and torsion of a final shaped article which occur due to the tensile stress which remains at the inside of a bent part when press-forming high strength steel sheet without formation of a bead at the final shaped article.

Solution to Problem

The inventors discovered that when press-forming a high strength steel sheet to form a final shaped article which comprises a top sheet part, vertical wall parts, and flange parts and which has at least one bent part with a minimum radius of curvature of 50 to 2000 mm in the longitudinal direction, the following is necessary to reduce the warping and torsion of the final shaped article.

The present invention divides the press-forming operation into:

1) a first shaping process of bending a flange part at an intersecting part until an angle of the flange part with a horizontal line becomes $\alpha_1$ in a plane which includes a horizontal line which connects an intersecting part of a vertical wall part and flange part and a center of curvature of the bent part and which is vertical to the high strength steel sheet and 2) a second shaping process of additionally bending the flange part after the first shaping process at the intersecting part until the angle of the flange part with the horizontal line becomes $\alpha_2$ in the plane.

The fact that when, at this time, the additional bending angle $\beta$ which is expressed by $\alpha_1$-$\alpha_2$ is in a predetermined range, warping and torsion of the final shaped article are reduced was discovered by the inventors. Further, the inventors discovered that even when using high strength steel sheet with a tensile strength of 440 to 4600 MPa where springback easily occurs, by making the additional bending angle $\beta$ a predetermined range, the amount of warping and the amount of torsion can be made the same extents as when using steel sheet with a tensile strength of less than 440 MPa.

The present invention was made based on the above discovery and has as its gist the following:

(1) A press-forming method for press-forming a final shaped article comprising a top sheet part, vertical wall parts, and flange parts and having at least one bent part in a longitudinal direction, the method comprising:

a first shaping process in which high strength steel sheet with a tensile strength of 440 to 1600 MPa is used, a flange part is bent at an intersecting part until an angle of the flange part with a horizontal line becomes $\alpha_1$ in a plane which includes a horizontal line which connects an intersecting part of a vertical wall part and a flange part and a center of curvature of the bent part and which is vertical to said high strength steel sheet when forming the top sheet part, vertical wall parts, bent part, and flange parts, and a second shaping process in which the flange part after the first shaping process is additionally bent at the intersecting part until the angle of the flange part with the horizontal line becomes $\alpha_2$ in that plane, and wherein when the radius of curvature of the bent part in said plane is $R_0$ (mm), the length of the flange parts is "b" (mm), the numerical value which shows the allowable value of strain is $\epsilon cr$, and the Young's modulus and tensile strength of said high strength steel sheet are E (MPa) and $\sigma_T$ (MPa), for $\alpha_1$ and $\alpha_2$, the direction of rotation starting from said horizontal line in the direction where the flange part moves away from the top sheet part is made positive, and $\alpha_1>0$, $\alpha_2\geq 0$, $\alpha_1-\alpha_2>0$, $R_0=50$ to 2000 mm, and $\epsilon cr=0$ to 0.023, $\alpha_1$-$\alpha_2$, that is, the additional bending angle $\beta$, is made the following ranges:

When Mathematical Formula 1

$$\cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]\leqq 90^\circ$$

$$\cos^{-1}\left[\frac{b\cos\alpha_2-\left(\frac{0.5\sigma_T}{E}\right)R_0}{b\left\{1-\left(\frac{0.5\sigma_T}{E}\right)\right\}}\right]-\alpha_2\leqq\beta\leqq$$

$$\cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]-\alpha_2$$

and

When Mathematical Formula 2

$$\cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]>90^\circ$$

$$\cos^{-1}\left[\frac{b\cos\alpha_2-\left(\frac{0.5\sigma_T}{E}\right)R_0}{b\left\{1-\left(\frac{0.5\sigma_T}{E}\right)\right\}}\right]-\alpha_2\leqq$$

$$\beta\leqq 90^\circ-\alpha_2$$

(2) The press-forming method according to (1) wherein the bent part is an arc or a curve with a curvature which continuously changes.

(3) The press-forming method according to (1) or (2) wherein at least at one of the first shaping process and the second shaping process, one of the facing dies is divided into a pad and a partial shaping die, the pad and the other of the facing dies press the steel sheet, and the partial shaping die and the other of the facing dies are used to make the steel sheet plastically deform.

Advantageous Effects of Invention

According to the present invention, even when using high strength steel sheet, it is possible to provide a final shaped article which comprises a top sheet part, vertical wall parts, and flange parts and which has at least one bent part with a radius of curvature of 50 to 2000 mm where the warping and torsion are suppressed without providing the final shaped article with a bead etc.

DESCRIPTION OF EMBODIMENTS

Figure 1:
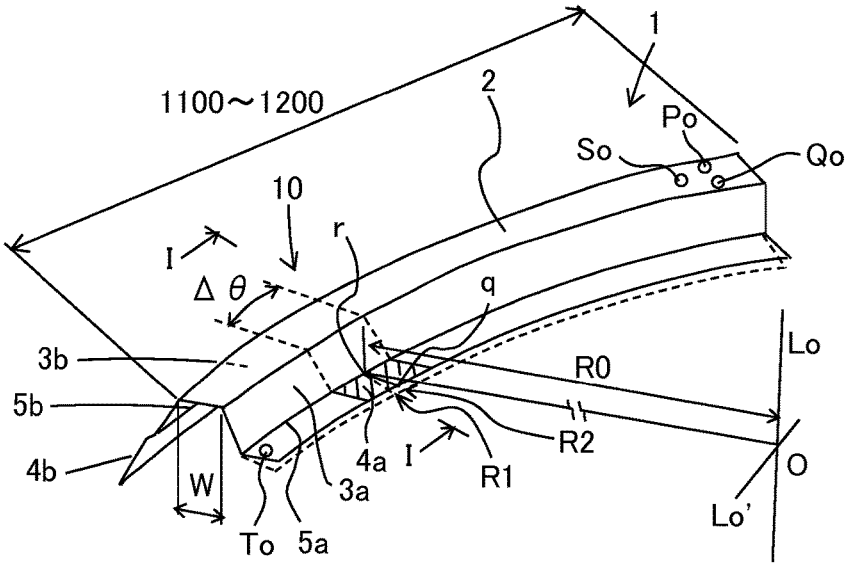
FIG. 1 is a view which shows one example of a final shaped article which has one bent part.
Figure 1:
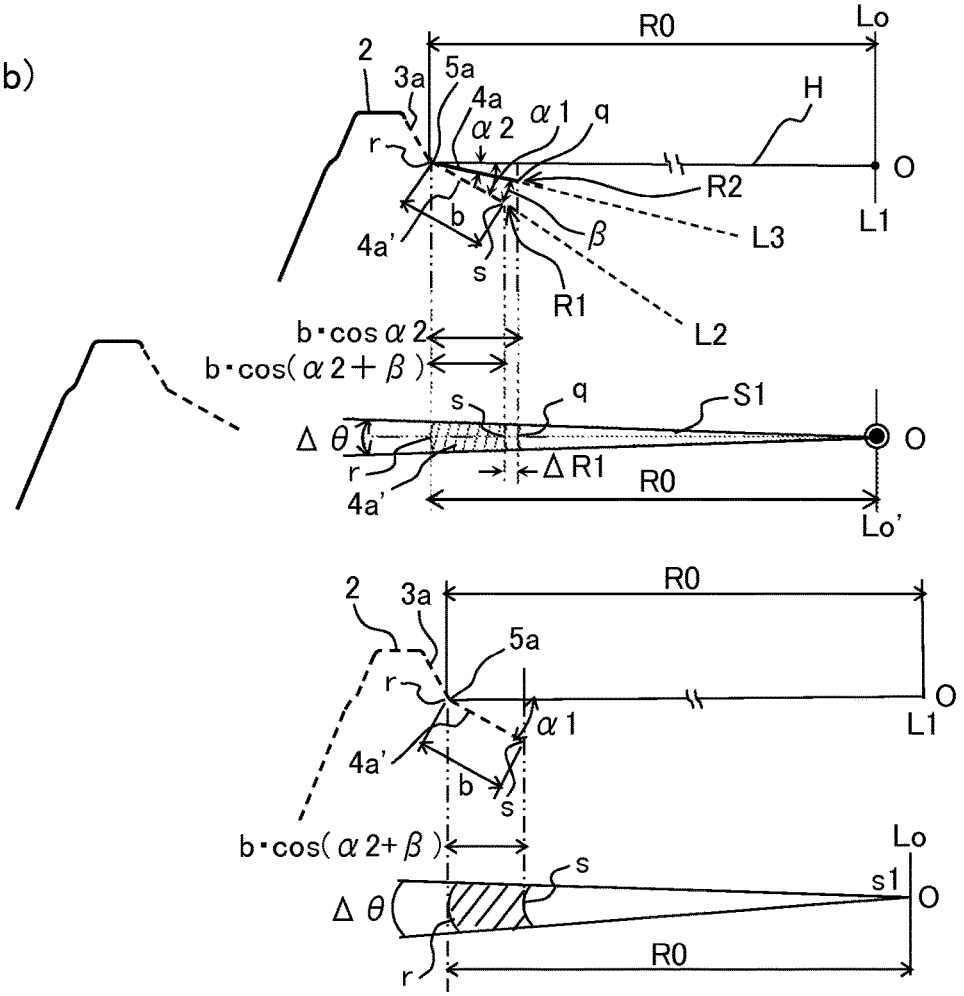

FIG. 1 is a view which shows one example of a final shaped article which comprises a top sheet part, vertical wall parts, and flange parts and which has one bent part with a radius of curvature of 50 to 2000 mm in the longitudinal direction. FIG. 1(*a*) is a perspective view, while FIG. 1(*b*) is a cross-sectional view along the line I-I which is shown in FIG. 1(*a*). In (a) of the figure, reference numeral 1 shows the final shaped article.

The final shaped article 1 comprises a top sheet part 2, vertical wall parts 3*a*, 3*b*, and flange parts 4*a*, 4*b*. The vertical wall part 3*a* and the flange part 4*a* are at the inside of the bent part 10, while the vertical wall part 3*b* and the flange part 4*b* are at the outside of the bent part 10. The vertical wall part 3*a* and the flange part 4*a* intersect at an intersecting part 5*a*. The vertical wall part 3*b* and the flange part 4*b* intersect at an intersecting part 5*b*.

FIG. 1(*b*) shows a cross-sectional view along the line I-I in FIG. 1(*a*). The cross-section which is shown by the solid lines is a cross-section after the second shaping process, that is, of the final shaped article 1. The position of the flange part 4*a* after the second shaping process is indicated as L3. Further, the cross-section which is shown by the broken lines is a cross-section of the flange part 4*a* after the first shaping process. The position of the flange part 4*a* after the first shaping process is indicated as L2.

For one position "r" of the bent part on the intersecting part 5*a* between the vertical wall part 3*a* and the flange part 4*a*, the center of curvature O with respect to the position "r" of the bent part and the line segment L1 which connects the center of curvature O and the position "r" are defined as in FIG. 1(*b*).

For the center of curvature O, consider the small range $\Delta\theta$ about the center axis of curvature L0 of the position "r" of the bent part. The small plane S1 which passes through the line segment L1 and includes the small range $\Delta\theta$ is defined. The small plane S1 forms part of the horizontal surface which includes the line segment L1 and the axis L0' vertical to the center axis of curvature L0. Note that, this horizontal plane is for convenience made horizontal as the reference plane. These explanations will be given by the cross-section along the line I-I in FIG. 1(*a*), that is, the cross-section which is shown in FIG. 1(*b*). The cross-section which is shown by FIG. 1(*b*) is a plane which includes a horizontal line H which connects the intersecting part 5*a* of the vertical wall part 3*a* and the flange part 4*a* and the center of curvature O of the bent part 10 and which is vertical to the steel sheet material.

The final shaped article 1 is formed as follows: First, for the steel sheet material, the flange part 4*a* is bent at the intersecting part 5*a* until the angle of the flange part 4*a* with respect to the horizontal line H becomes $\alpha_1$. This bending operation is referred to as the "first shaping process". Next, the flange part 4*a* after the first shaping process is additionally bent at the intersecting part 5*a* until the angle of the flange part with respect to the horizontal line H becomes $\alpha_2$. This additional bending operation is referred to as the "second shaping process". That is, in the first shaping process, the steel sheet material is formed into the intermediate product, then in the second shaping process, the flange part 4*a* of the intermediate product is further additionally bent to obtain the final shaped article 1.

After the end of the first shaping process, tensile stress remains at the vertical wall part 3*a* and the flange part 4*a* at the inside of the bent part 10. This tensile residual stress becomes a cause of springback. Therefore, after the first shaping process, an additional bending operation (second shaping process) is used to plastically deform the intersecting part 5*a* of the vertical wall part 3*a* and the flange part 4*a* by compression. As a result, the tensile residual stress at the time of the end of the first shaping process is reduced and warping and torsion of the final shaped article 1 can be suppressed.

In the cross-section which is shown in FIG. 1(*b*), the radius of curvature $R_0$ (mm) of the bent part 10 is defined at the intersecting part 5*a* of the vertical wall part 3*a* and the flange part 4*a* in the cross-section. Here, the radius of curvature of the front end of the flange part 4*a* at the time of the end of the first shaping process is indicated as $R_1$ (mm). At the time of the end of the second shaping operation, that is, at the final shaped article, the radius of curvature of the front end of the flange part 4*a* is indicated as $R_2$ (mm). Further, the length of the flange part 4*a* is indicated as "b" (mm). In this case, $$R_1=R_0-b\cos\alpha_1$$

$$R_2=R_0-b\cos\alpha_2$$

Note that, $R_0$, $R_1$, and $R_2$ are made the radii of curvature at the small range $\Delta\theta$. Therefore, the bent part 10 can be made a free curved surface where the curvature continuously changes.

At this time, the strain $\epsilon_1$ which is given to the front end part of the flange 4*a* is expressed by the following:

$$\epsilon_1=(R_1-R_2)/R_1=b(\cos\alpha_2-\cos\alpha_1)/(R_0-b\cos\alpha_1)$$

From the above $\epsilon_1$, the angle $\alpha_1$ which is formed by the vertical wall part 3*a* and the flange part 4*a* which are formed in the first shaping process becomes:

$$\alpha_1=\cos^{-1}\{(b\cos\alpha_2-\epsilon_1R_0)/b(1-\epsilon_1)\}$$

Therefore, the additional bending angle β for changing $\alpha_1$ to $\alpha_2$ becomes:

$$\beta=\alpha_1-\alpha_2=\cos^{-1}\{(b\cos\alpha_2-\epsilon_1R_0)/(b(1-\epsilon_1)\}-\alpha_2 \quad \text{(A)}$$

Here, the strain $\epsilon_1$ which is given to the front end part of the flange 4*a* is $\epsilon_1=\sigma_T/E$ (where, $\sigma_T$ is the tensile strength (MPa) of steel sheet, and E is the Young's modulus (MPa) of steel sheet) if steel sheet with a tensile strength of less than 440 MPa (for example, soft steel sheet etc.)

However, when the tensile strength of the steel sheet which is used as the material for press-forming is 440 to 1600 MPa, that is, in the case of high strength steel sheet (high tensile strength steel sheet), there is the phenomenon of $\epsilon_1$ becoming smaller than $\sigma_T/E$.

Figure 2:
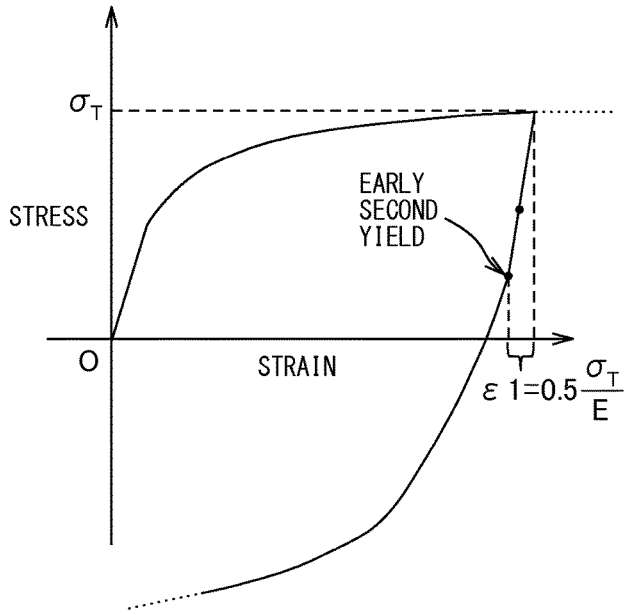
FIG. 2 shows the change in stress which is applied to the high strength steel sheet when applying tensile and compressive load to the high strength steel sheet.

This phenomenon will be explained. FIG. 2 shows the change in stress which is applied to high strength steel sheet when high strength steel sheet with a tensile strength of 440 to 1600 MPa is given a tensile load right before break and then is given a compressive load.

High strength steel sheet with a tensile strength of 440 to 1600 MPa, due to the Bauschinger effect, suffers from an early yield phenomenon where at the time of stress reversal, the stress Δσ which is required for the high strength steel sheet to second yield decreases from the usual yield stress. Accordingly, $\epsilon_1$ also decreases.

Here, $\epsilon_1$ is the compressive strain which is given for reducing the tensile stress which remains at the inside of the bent part 10 and causes springback. The lower limit of compressive strain is given by $\epsilon_1=0.5\sigma_T/E$. On the other hand, the upper limit of compressive strain is given by $\epsilon_1=0.5\sigma_T/E+\epsilon_{cr}$. Here, $\epsilon_{cr}$ is the allowable value of strain where the flange part 4*a* of the final shaped article 1 does not wrinkle. The range of $\epsilon_{cr}$ is found by experiments and is 0 to 0.023. That is, in the final shaped article 1, the flange part 4*a* does not wrinkle when $\epsilon_1$ is in the range of $0.5\sigma_T/E$ to $(0.5\sigma_T/E)+\epsilon_{cr}$. The same is true in the case of using the first shaping process to obtain the intermediate product.

If converting the range of $\epsilon_1$ to the range of the additional bending angle β based on the above formula (A), the result becomes the Mathematical Formula 3

$$\cos^{-1}\left[\frac{b\cos\alpha_2-\left(\frac{0.5\sigma_T}{E}\right)R_0}{b\left\{1-\left(\frac{0.5\sigma_T}{E}\right)\right\}}\right]-\alpha_2 \leqq \beta \leqq \cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]-\alpha_2$$

Figure 12:
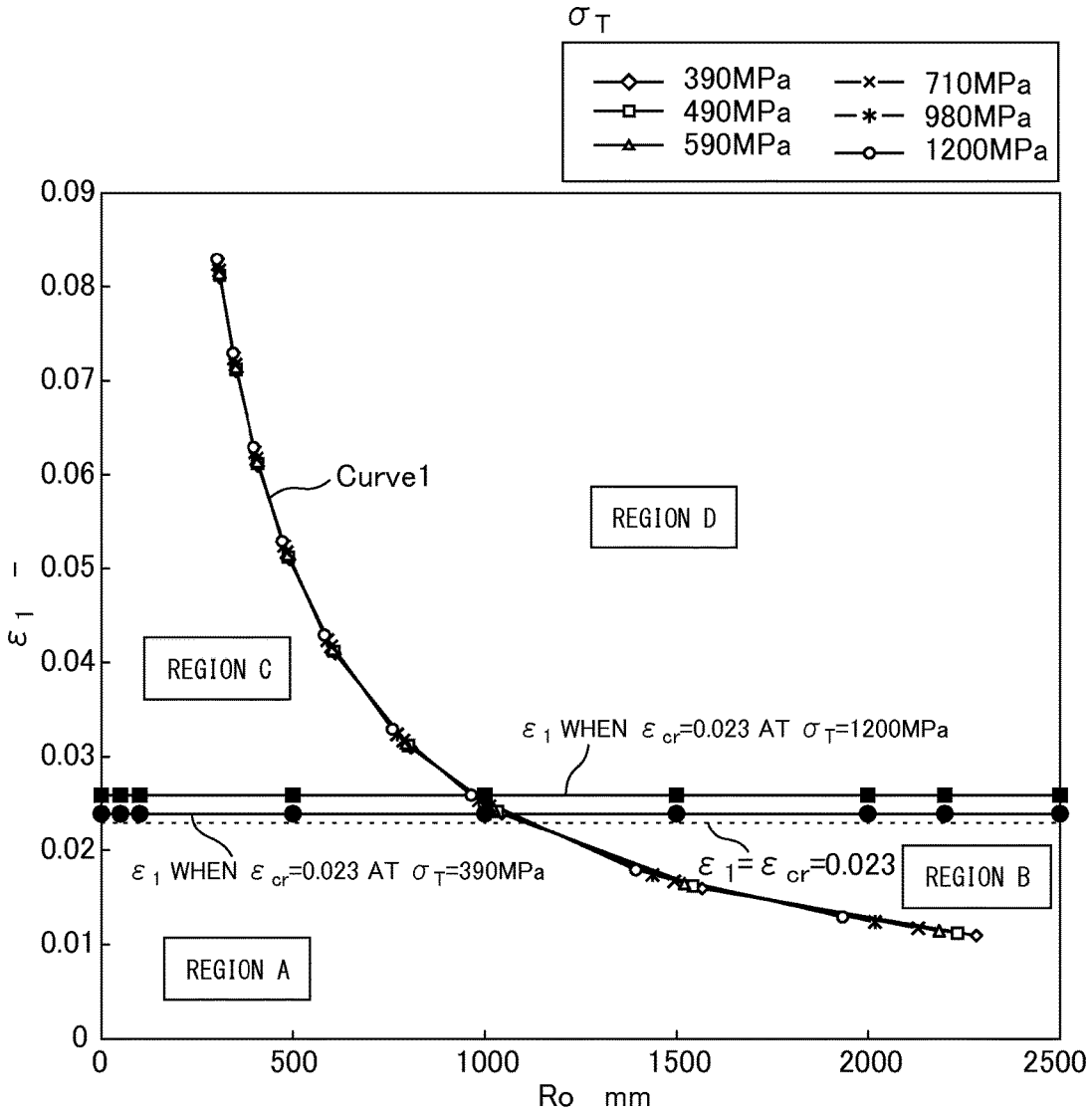
FIG. 12 is a view which shows the effect of the radius of curvature $R_0$ (mm) of the bent part 10 and the $\epsilon_1$ which is applied to the final shaped article on the warping, torsion, and wrinkles of the final shaped article.

FIG. 12 is a view, prepared based on the above inequality, which shows the effect of the radius of curvature $R_0$ (mm) and compressive strain $\epsilon_1$ of the bent part 10 on the warping, torsion, and wrinkles of the final shaped article. In FIG. 12, Curve 1 is the curve which shows Mathematical Formula 4

$$b\cos\alpha_2-\left(\frac{0.5\sigma_T}{E}+\varepsilon cr\right)R_0=0$$

when the tensile strength $\sigma_T$ of the steel sheet which is used as a material is 390, 490, 590, 710, 930, and 1200 MPa.

In FIG. 12, the range of $\epsilon_1$ and the vertical direction of the Curve 1 can be divided into the region A to region D. The regions A and B are regions where $\epsilon_{cr}$ is 0 to 0.023 in range, that is, regions where $\epsilon_1$ is a value of $0.5\sigma_T/E$ plus the allowable value $\epsilon_{cr}$ of strain. That is, the value of the upper limit of $\epsilon_1$ at the regions A and B changes depending on the $\sigma_T$ of the material. FIG. 12 shows as typical examples the values of $\epsilon_1$ when $\epsilon_{cr}=0.023$ at the values of $\sigma_T=390$ MPa and 1200 MPa by two lines. The value of $\epsilon_1$ of a steel material with a $\sigma_T$ of 390 to 1200 MPa may be considered to be substantially between these two lines. Therefore, in the region A and the region B, the intermediate product and the final shaped article are formed without causing wrinkling. On the other hand, in the region C and the region D, $\epsilon_1$ is over 0.023, so even if formed, the intermediate product and the final shaped article are wrinkled.

Figure 13:
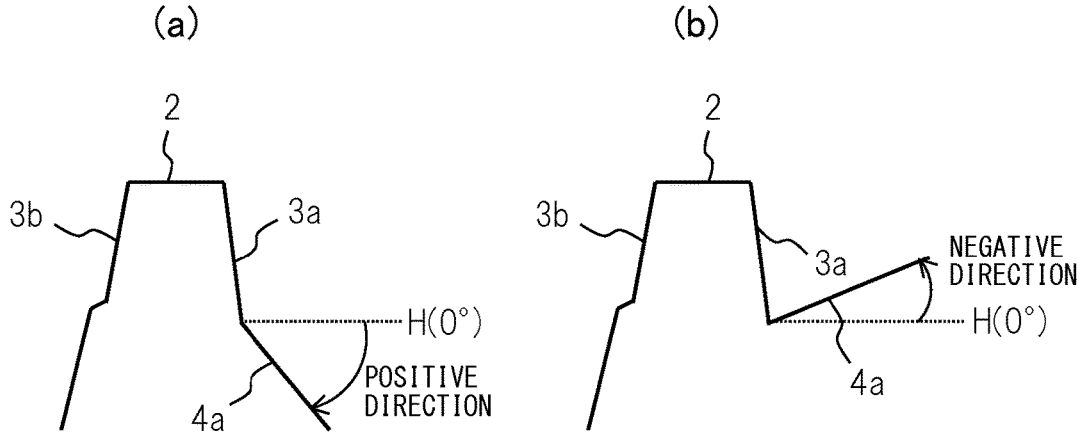
FIG. 13 is a view which explains the positive and negative directions of $\alpha_1$ and $\alpha_2$.

Here, to obtain a final shaped article with small warping and torsion without causing wrinkling, in the region A and the region B where $\epsilon_1$ is εcr, the additional bending angle β which is defined by $\alpha_1$-$\alpha_2$ has to be made a predetermined range. Below, the range of the additional bending angle β will be explained divided into the region A and the region B. Note that, for $\alpha_1$ and $\alpha_2$, as shown in FIG. 13(*a*), the direction of rotation starting from the position of the horizontal line H in the direction where the flange part 4*a* moves away from the top sheet part 2 is defined as "positive". Conversely, the direction of rotation starting from the position of the horizontal line H in the direction where the flange part 4*a* moves toward from the top sheet part 2 is defined as "negative".

In FIG. 12, region A, when making $\alpha_1>0$, $\alpha_2\geq 0$, $\alpha_1-\alpha_2>0$, and $R_0=50$ to 2000 mm, $\alpha_1-\alpha_2$, that is, the additional bending angle β, has to be made the range of When Mathematical Formula 5

$$\cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]\leqq 90^\circ$$

$$\cos^{-1}\left[\frac{b\cos\alpha_2-\left(\frac{0.5\sigma_T}{E}\right)R_0}{b\left\{1-\left(\frac{0.5\sigma_T}{E}\right)\right\}}\right]-\alpha_2\leqq\beta\leqq$$

$$\cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]-\alpha_2.$$

Figure 14:
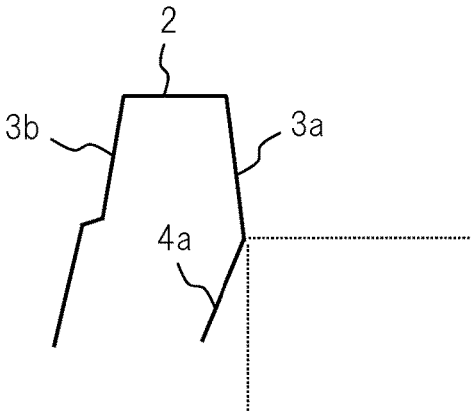
FIG. 14 shows the cross-section of a final shaped article along the line I-I in FIG. 1(*a*) when $\alpha_2+\beta$ exceeds 90°.

Here, as shown in FIG. 12, if Ro becomes larger or $\epsilon_1$ becomes larger, the value of Mathematical Formula 6

$$b\cos\alpha_2-\left(\frac{0.5\sigma_T}{E}+\varepsilon cr\right)R_0$$

sometimes becomes a negative value. The value for calculating the arc cosine from this value is, as explained above, $\alpha_1$, so this value becoming negative means the value of $\alpha_1$ is over 90°. If the value of α1 is over 90°, as shown in FIG. 14, the angle which the flange part 4*a* forms with the vertical wall part 3*a* becomes 180° or less. If considering a die such as in FIG. 4, the die cannot be pulled out and the shaped article cannot be produced. Therefore, the region A Mathematical Formula 7

$$b\cos\alpha_2 - \left(\frac{0.5\sigma_T}{E} + \varepsilon cr\right)R_0$$

being positive is a required condition. Under this condition, the value of $\alpha_1$ minus $\alpha_2$, that is, the value of β, can be found. The value of the upper limit of β can be found as 0.023 of the value of the upper limit $\epsilon_{cr}$ where no wrinkles occur. Further, theoretically, $\epsilon_{cr}$ may also be zero. In this case, the value of $\epsilon_1$ is made $0.5\sigma_T/E$. Accordingly, as the range of β, $\epsilon_1$ changes from $\sigma_T/E$ in the range of the value which is calculated in the range of $0.5\sigma_T/E+\epsilon_{cr}$.

The processing method of the present invention provides a shaping method which first bends the material by a small amount, then further bends it in the same direction, so $\alpha_1 \leq 0$ never stands. Further, large bending from the start is not preferable since the material easily wrinkles. Further, $\alpha_2 < 0$ is not preferable since deformation of the flange parts causes the flange part to easily wrinkle. Further, if $\alpha_1-\alpha_2 \leq 0$, the present invention provides a shaping method which first bends the material by a small amount, then further bends it in the same direction, so $\alpha_1-\alpha_2 \leq 0$ never stands. Further, $\alpha_1-\alpha_2 \leq 0$ is not preferable since the material is worked in the reverse direction and easily wrinkles at the time of the first shaping operation. Therefore, $\alpha_1 > 0$, $\alpha_2 \geq 0$, and $\alpha_1-\alpha_2 > 0$ are set.

Further, if $R_0$ is less than 50 mm, at the time of the end of the first shaping process, the tensile stress which remains at the vertical wall part 3*a* and the flange part 4*a* at the inside of the bent part 10 becomes extremely large. Therefore, even if making β the range of the above inequality, it is not possible to relieve the residual tensile stress at the second shaping process. As a result, the warping and torsion of the final shaped article 1 become larger. On the other hand, if $R_0$ exceeds 2000 mm, the final shaped article 1 becomes straight in shape in the longitudinal direction, so at the time of end of the first shaping process, the tensile stress which remains at the vertical wall part 3*a* and the flange part 4*a* at the inside of the bent part 10 becomes smaller. Accordingly, even if not applying the present invention, the warping and torsion of the final shaped article 1 are small. Furthermore, when the final shaped article has a plurality of curvatures, in the present invention, the minimum radius of curvature is made $R_0$.

Further, when

Mathematical Formula 8

$$\cos^{-1}\left[\frac{b\cos\alpha_2 - \left(\frac{0.5\sigma_T}{E} + \varepsilon cr\right)R_0}{b\left\{1 - \left(\frac{0.5\sigma_T}{E} + \varepsilon cr\right)\right\}}\right] > 90^\circ$$

$\alpha_2+\beta$, that is, $\alpha_1$, exceeds 90° starting from the horizontal line. FIG. 14 shows the cross-section of the final shaped article at the line I-I in FIG. 1(*a*) when $\alpha_2+\beta$, that is, $\alpha_1$, exceeds 90°. As shown in FIG. 14, the flange part 4*a* becomes inclined in reverse with respect to the direction of advance of the die. It is clear that it is not possible to use the die to form the final shaped article 1.

Further, when the range of the additional bending angle β does not satisfy the

Mathematical Formula 9

$$\cos^{-1}\left[\frac{b\cos\alpha_2 - \left(\frac{0.5\sigma_T}{E}\right)R_0}{b\left\{1 - \left(\frac{0.5\sigma_T}{E}\right)\right\}}\right] - \alpha_2 \leqq \beta \leqq \cos^{-1}\left[\frac{b\cos\alpha_2 - \left(\frac{0.5\sigma_T}{E} + \varepsilon cr\right)R_0}{b\left\{1 - \left(\frac{0.5\sigma_T}{E} + \varepsilon cr\right)\right\}}\right] - \alpha_2$$

while the intermediate product and final shaped article 1 can be formed without causing wrinkling, the warping and torsion of the final shaped article 1 are large.

Next, in the region B of FIG. 12, when making $\alpha_1 > 0$, $\alpha_2 \leq 0$, $\alpha_1-\alpha_2 > 0$, and $R_0$=50 to 2000 mm, the range of $\alpha_1-\alpha_2$, that is, the additional bending angle β, has to be made the When Mathematical Formula 10

$$\cos^{-1}\left[\frac{b\cos\alpha_2 - \left(\frac{0.5\sigma_T}{E} + \varepsilon cr\right)R_0}{b\left\{1 - \left(\frac{0.5\sigma_T}{E} + \varepsilon cr\right)\right\}}\right] > 90^\circ$$

$$\cos^{-1}\left[\frac{b\cos\alpha_2 - \left(\frac{0.5\sigma_T}{E}\right)R_0}{b\left\{1 - \left(\frac{0.5\sigma_T}{E}\right)\right\}}\right] - \alpha_2 \leqq \beta \leqq 90^\circ - \alpha_2$$

The reasons for making $\alpha_1 > 0$, $\alpha_2 \geq 0$, $\alpha_1-\alpha_2 > 0$, and $R_0$=50 to 2000 mm are similar to those of the case of region A.

Further, when not satisfying

Mathematical Formula 11

$$\cos^{-1}\left[\frac{b\cos\alpha_2 - \left(\frac{0.5\sigma_T}{E} + \varepsilon cr\right)R_0}{b\left\{1 - \left(\frac{0.5\sigma_T}{E} + \varepsilon cr\right)\right\}}\right] > 90^\circ$$

as explained above, $\alpha_2+\beta$, that is, $\alpha_1$, exceeds the 90° starting from the horizontal line and the flange part 4*a* becomes inversely inclined with respect to the direction of advance of the die, so it is not possible to use the die for shaping. Therefore, the upper limit of the additional bending angle β was made $90°-\alpha_2$. Here, $\alpha_1$=90°.

By making the additional bending angle β the range which was explained up to here, it is possible to obtain a final shaped article 1 which is free of wrinkling at the flange part 4*a* and which has small warping and torsion.

Figure 3:
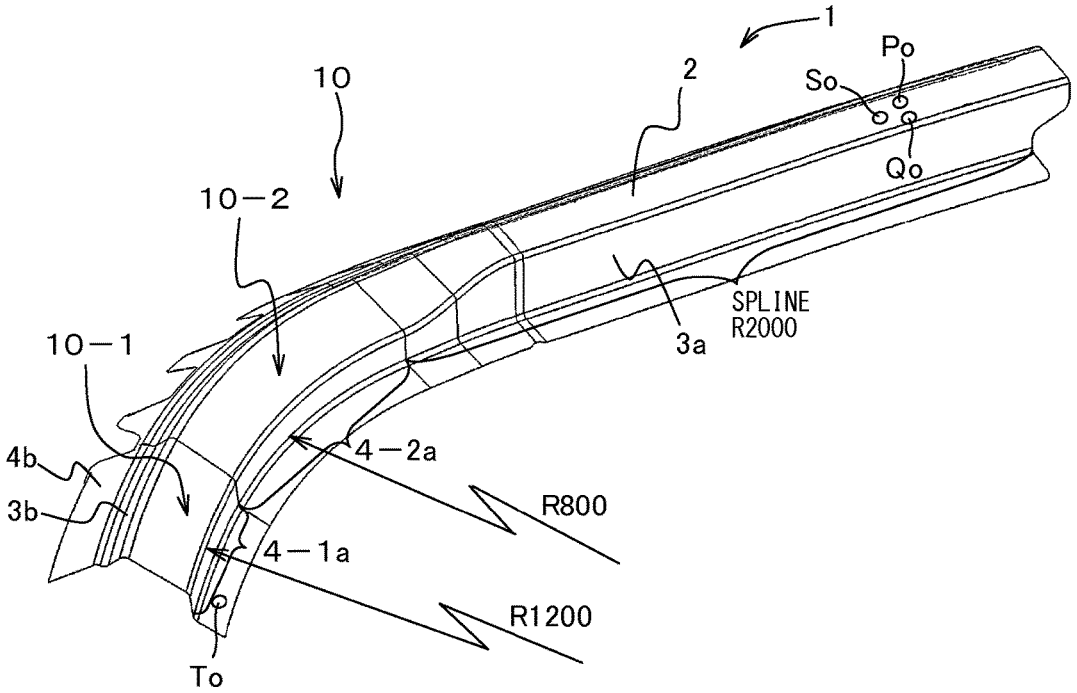
FIG. 3 is a view which shows a final shaped article which has two bent parts.
Figure 7:
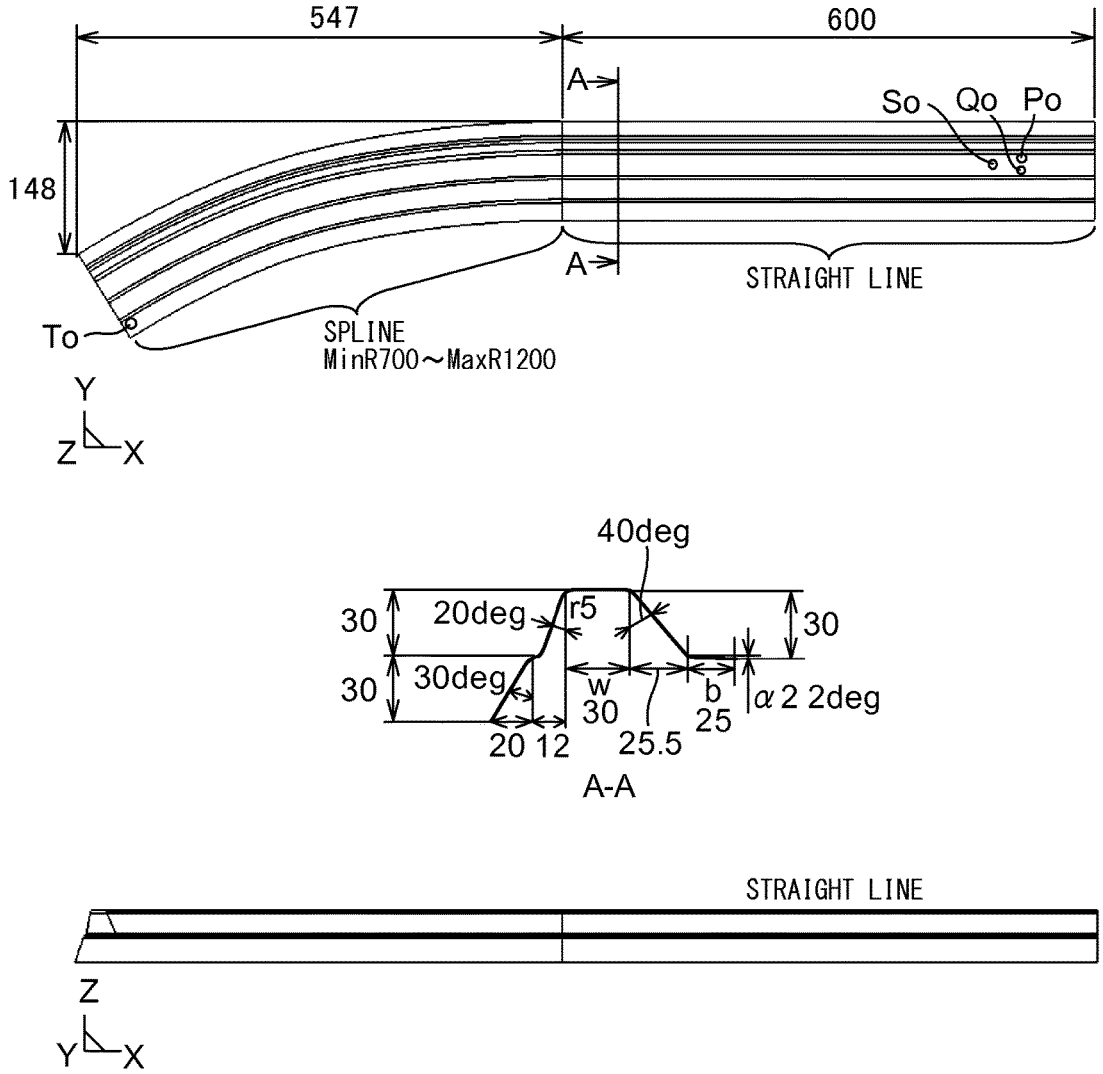
FIG. 7 is a view which shows the shape of a final shaped article which has a portion of a bent part with a radius of curvature which continuously changes in the range of 700 to 1200 mm and has a straight part and which gently curves in the longitudinal direction when seen from a top view.

The present invention can be applied to any final shaped article 1 so long as shaped as shown in FIGS. 1, 3, and 7 to 1. A final shaped article 1 of the shape such as shown in FIGS. 1, 3, and 7 to 11 includes for example a front side member, inner front pillar, inner roof rail, etc. of an automobile.

The bent part 10 has an arc shape, elliptical arc shape, or curved shape with continuously changing curvature at the intersecting parts 5*a*, 5*b*, but is not limited to a curved shape with a radius of curvature of the curve of 50 to 2000 mm.

Further, bent part 10 is not limited to a single one at the final shaped article 1. There may also be several present. FIG. 3 is view which shows one example of a final shaped article 1 with a hat shaped cross-section which comprises a top sheet part, vertical wall parts, and flange parts and has two bent parts with radii of curvature of 800 and 1200 in the longitudinal direction.

The final shaped article 1 of FIG. 3 has the bent parts 10-1 and 10-2, but the flange parts 4-1*a*, 4-2*a* at the insides of these bent parts 10-1, 10-2 are respectively additionally bent in the range of the above β.

In the final shaped article 1 of FIG. 3 as well, the tensile stress which remains at the end of the first shaping process at the vertical wall parts 3*a*, 3-1*a*, 3-2*a* and the flange parts 4*a*, 4-1*a*, 4-2*a* at the insides of the bent parts 10, 10-1, 10-2 is reduced in the second shaping process. As a result, the final shaped article 1 of FIG. 3 is also reduced in warping and torsion and the flange parts 4*a*, 4-1*a*, and 4-2*a* are not wrinkled.

In the final shaped article 1 of FIG. 1, the width W of the top sheet part 2*a* is not particularly limited. However, if the width W is narrower than 15 to 30 mm, the next explained method is preferably used for press-forming. Note that, the "width W" means the width in a direction perpendicular to the longitudinal direction at the top sheet part 2 of the final shaped article 1 of FIG. 1.

Figure 4:
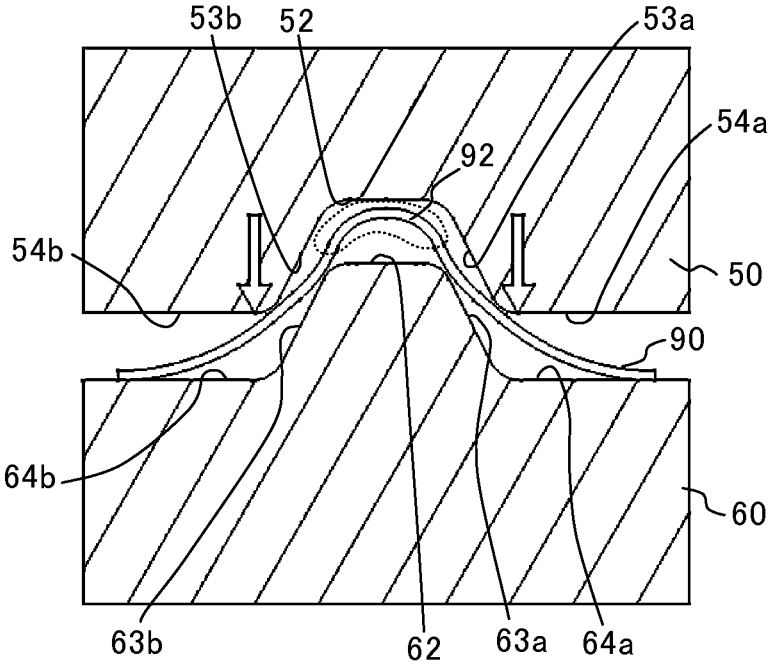
FIG. 4 is a schematic view which shows an outline of the cross-sectional shape of a part which forms a bent part in a die which is used in the first shaping process.
Figure 5:
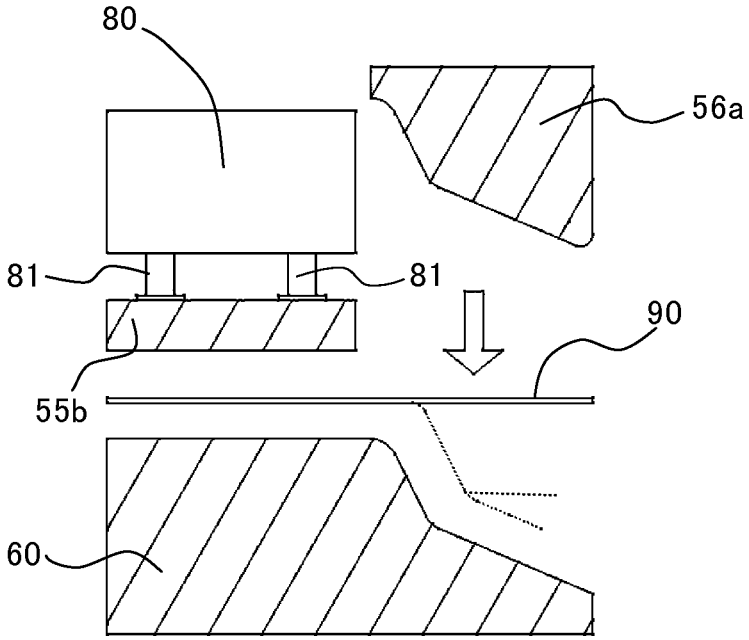
FIG. 5 is a schematic view which shows an outline of the cross-sectional shape of a part which forms a bent part in a die which is used in the first shaping process when forming a final shaped article with a width W of 15 to 30 mm.
Figure 6:
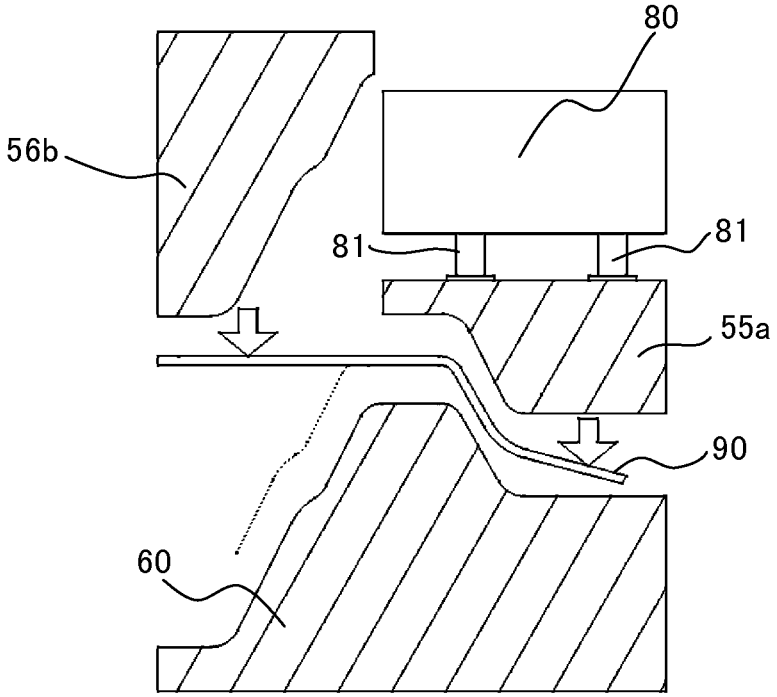
FIG. 6 is a schematic view which shows an outline of the cross-sectional shape of a part which forms a bent part in a die which is used in the second shaping process when forming a final shaped article with a width W of 15 to 30 mm.

FIG. 4 is a schematic view which shows an outline of the cross-sectional shape of a part which forms a bent part 10 in a die which is used in the first shaping process in the dies which are used for press-forming the final shaped article 1 of FIG. 1. FIG. 5 is a schematic view which shows an outline of the cross-sectional shape of a part which forms a bent part 10 in a die which is used in the first shaping process in the dies which are used for press-forming a final shaped article 1 of FIG. 1 with a width W of 15 to 30 mm. FIG. 6 is a schematic view which shows an outline of the cross-sectional shape of a part which forms a bent part 10 in a die which is used in the second shaping process in the dies which are used for press-forming a final shaped article 1 of FIG. 1 with a width W of 15 to 30 mm.

As shown in FIG. 4, the first die 50 and the second die 60 have top sheet part shaping surfaces 52, 62, inside vertical wall part shaping surfaces 53*a*, 63*a*, outside vertical wall part shaping surfaces 53*b*, 63*b*, inside flange part shaping surfaces 54*a*, 64*a*, and outside flange part shaping surfaces 54*b*, 64*b*.

In the first shaping process, when the steel sheet 90 is gripped between the first die 50 and the second die 60, the location 92 of the final shaped article 1 which becomes the top sheet part 2 rises up from the top sheet part shaping surface 62 of the second die 60. Further, the location 92 greatly bends in the sheet thickness direction of the steel sheet 90. At this time, the location 92 of the final shaped article 1 which becomes the top sheet part 2 is acted on by a moment in the sheet thickness direction of the steel sheet 90 and stress which acts to bend the final shaped article 1 as a whole (below, bending stress) remains at the top sheet part 2. This remaining bending stress reduces the effect at the second shaping process of reduction of the tensile stress which remains at the time of the end of the first shaping process. To keep bending stress from remaining, the shaping pressure has to be made larger. However, when the width W of the final shaped article 1 is a narrow 15 to 30 mm, a particularly large shaping pressure is required.

Therefore, in the dies which are used in the first shaping process, when the width W is a narrow one of 15 to 30 mm, the first die 50 of FIG. 4, as shown in FIG. 5, is divided into the pad 55*b* and the partial shaping die 56*a*. Due to this, the parts of the final shaped article 1 which form the outside vertical wall part 3*b* and outside flange part 4*b* are gripped by the pad 55*b* and the second die 60 while the partial shaping die 56*a* forms the inside vertical wall part 3*a* and inside flange part 4*a*. That is, the steel sheet 90 is pressed by the pad 55*b* and the second die 60, then the partial shaping die 56*a* and the second die 60 are used to make the steel sheet 90 plastically deform to form the inside vertical wall part 3*a* and inside flange part 4*a*. By doing this, it is possible to prevent bending stress from remaining at the top sheet part 2 without increasing the shaping pressure. Note that, the pad 55*b* is pressed against the second die 60 by small-sized hydraulic cylinders 81 which are attached to the press machine 80. The steel sheet 90 is just sandwiched between the pad 55*b* and the second die 60, so a large load is not required.

Further, by making the dies which are used for the second shaping process, as shown in FIG. 6, the second die 60, pad 55*a*, and partial shaping die 56*b*, the top sheet part 2 and inside vertical wall part 3*a* are gripped by the pad 55*a* and the second die 60 while the pad 55*a* is used to additionally bend the inside flange part 4*a*, and the partial shaping die 56*b* and die 60 are used to form the outside vertical wall part 3*b* and outside flange part 4*b*. That is, the intermediate shaped article which was obtained at the first shaping process is pressed by the pad 55*a* and the second die 60 while the pad 55*a* and the die 60 are used to make the inside flange part 4*a* plastically deform to additionally bend, and the partial shaping die 56*b* and die 60 are used to make the steel sheet 90 plastically deform to form the outside vertical wall part 3*b* and outside flange part 4*b*. By doing this, it is possible to prevent bending stress from remaining at the top sheet part 2. Note that, the pad 55*a* is pressed by the small-sized hydraulic cylinders 81 which are attached to the press machine 80. This is because a large load is not required for additionally bending the inside flange parts 4*a*.

As explained up to here, in the first shaping process, the pad 55*b* and the second die 60 grip the top sheet part 2 and inside vertical wall part 3*a* while the partial shaping die 56*a* shapes the top sheet part 2 and the inside vertical wall part 3*a* and inside flange part 4*a*. Further, in the second shaping process, the pad 55*a* is used to additionally bend the inside flange part 4*a* after the first shaping process while the partial shaping die 56*b* is used to shape the outside vertical wall part 3*b* and outside flange part 4*b*.

By shaping in this way, it is possible to further enhance the effect of reduction of warping and torsion of the final shaped article 1 which is obtained by additional bending of the inside flange part 4*a*. In particular, it is effective when W is 15 to 30 mm.

EXAMPLES

Next, the present invention will be explained further by examples, but the conditions in the examples are examples of conditions which are employed for confirming the workability and effects of the present invention. The present invention is not limited to these examples of conditions. The present invention can employ various conditions so long as not deviating from the gist of the present invention and achieving the object of the present invention.

Example 1

Steel sheets of various sheet thicknesses and tensile strengths were used for press-forming operations by the method of the present invention to fabricate the final shaped articles 1 which are shown in FIG. 1, FIG. 3, and FIG. 11*a* to FIG. 11*i*.

The fabricated final shaped articles 1 were all evaluated for warping and torsion in the following way. Each of the final shaped articles 1 was measured for positions of the four points $P_0$, $Q_0$, $S_0$, $T_0$ which are shown in FIG. 1 and FIG. 3. The coordinates were designated as the points P, Q, S, and T. Further, the line segment $T_0T$ when fixing the three points $P_0$=P, $Q_0$=Q, and $S_0$=S was defined as the "amount of warping and torsion". That is, when there is no warping and torsion at all, $P_0$=P, $Q_0$=Q, $S_0$=S, and $T_0$=T, so the amount of warping and torsion which is shown by the line segment $T_0T$ become 0. Note that, the four points $P_0$, $Q_0$, $S_0$, and $T_0$ in FIG. 11*a* to FIG. 11*i* are based on FIG. 1 and FIG. 3.

The results of evaluation are shown in Table 1. In Table 1, the final shaped article 1 corresponds to any of FIG. 1, FIG. 3, and FIG. 11*a* to FIG. 11*i*, but the value of the width W, the sheet thickness and the tensile strength of the steel sheet which is used, the additional bending angle β, the use of pads 55*a*, 55*b*, etc. are also described together.

TABLE 1

| Exp. level | Final shaped article shape | W (mm) | Sheet thickness (mm) | Tensile strength $\sigma_Y$ (MPa) | Young's modulus E (MPa) | b (mm) | $R_0$ (mm) | $\alpha_1$ (°) | $\alpha_2$ (°) | εcr (—) | Range able to be taken by β Min. (°) | Range able to be taken by β Max. (°) | β (°) | Pad use | Am't of warping and torsion (mm) | Wrinkles | Remarks |
|---|---|---|---|---|---|---|---|---|---|---|---|---|---|---|---|---|---|
| 1-1 | FIG. 1 | 45 | 1.0 | 490 | 205800 | 25 | 1000 | 22 | 2 | 0.023 | 15.7 | 86.1 | 20.0 | No | 10.7 | No | Inv. ex. |
| | | | | | | | | 14 | | 0.023 | 15.7 | 86.1 | 12.0 | | 14.9 | No | Comp. ex. |
| | | | | | | | | 90 | | 0.023 | 15.7 | 86.1 | 88.0 | | 15.2 | No | Comp. ex. |
| | | | | | | | | — | | — | — | — | — | | 18.0 | No | Prior ex. |
| 1-2 | FIG. 1 | 45 | 1.0 | 590 | 205800 | 25 | 1000 | 22 | 2 | 0.023 | 17.4 | 86.7 | 20.0 | No | 10.8 | No | Inv. ex. |
| | | | | | | | | 14 | | 0.023 | 17.4 | 86.7 | 12.0 | | 16.9 | No | Comp. ex. |
| | | | | | | | | 90 | | 0.023 | 17.4 | 86.7 | 88.0 | | 17.8 | No | Comp. ex. |
| | | | | | | | | — | | — | — | — | — | | 18.2 | No | Prior ex. |
| 1-3 | FIG. 1 | 45 | 1.0 | 710 | 205800 | 25 | 1000 | 22 | 2 | 0.023 | 19.3 | 87.4 | 20.0 | No | 11.1 | No | Inv. ex. |
| | | | | | | | | 19 | | 0.023 | 19.3 | 87.4 | 17.0 | | 17.5 | No | Comp. ex. |
| | | | | | | | | 90 | | 0.023 | 19.3 | 87.4 | 88.0 | | 18.1 | No | Comp. ex. |
| | | | | | | | | — | | 0.023 | — | — | — | | 18.9 | No | Prior ex. |
| 1-4 | FIG. 1 | 45 | 1.0 | 980 | 205800 | 25 | 1000 | 26 | 2 | 0.023 | 23.0 | 88.0 | 24.0 | No | 11.8 | No | Inv. ex. |
| | | | | | | | | 25 | | 0 | 23.0 | 23.0 | 23.0 | | 11.3 | No | Inv. ex. |
| | | | | | | | | 20 | | 0.023 | 23.0 | 88.0 | 18.0 | | 17.7 | No | Comp. ex. |
| | | | | | | | | — | | — | — | — | — | | 19.4 | No | Prior ex. |
| 1-5 | FIG. 1 | 45 | 1.0 | 1200 | 205800 | 25 | 1000 | 28 | 2 | 0.023 | 25.7 | 88.0 | 26.0 | No | 12.5 | No | Inv. ex. |
| | | | | | | | | 22 | | 0.023 | 25.7 | 88.0 | 20.0 | | 18.2 | No | Comp. ex. |
| | | | | | | | | — | | — | — | — | — | | 20.2 | No | Prior ex. |
| 1-6 | FIG. 1 | 25 | 1.0 | 590 | 205800 | 25 | 1000 | 22 | 2 | 0.023 | 17.4 | 86.7 | 20.0 | No | 11.0 | No | Inv. ex. |
| | | | | | | | | 17 | | 0.023 | 17.4 | 86.7 | 15.0 | | 17.5 | No | Comp. ex. |
| | | | | | | | | 90 | | 0.023 | 17.4 | 86.7 | 88.0 | | 18.1 | No | Comp. ex. |
| | | | | | | | | — | | — | — | — | — | | 18.6 | No | Prior ex. |
| 1-7 | FIG. 1 | 25 | 1.0 | 590 | 205800 | 25 | 1000 | 22 | 2 | 0.023 | 17.4 | 86.7 | 20.0 | Yes | 6.2 | No | Inv. ex. |
| | | | | | | | | 17 | | 0.023 | 17.4 | 86.7 | 15.0 | | 9.9 | No | Comp. ex. |
| | | | | | | | | 90 | | 0.023 | 17.4 | 86.7 | 88.0 | | 10.1 | No | Comp. ex. |
| | | | | | | | | — | | — | — | — | — | | 10.5 | No | Prior ex. |
| 1-8 | FIG. 1 | 45 | 1.2 | 980 | 205800 | 25 | 1000 | 26 | 2 | 0.023 | 23.0 | 88.0 | 24.0 | No | 11.8 | No | Inv. ex. |
| | | | | | | | | 26 | | 0.023 | 23.0 | 88.0 | 18.0 | | 17.6 | No | Comp. ex. |
| | | | | | | | | — | | — | — | — | — | | 19.2 | No | Prior ex. |
| 1-9 | FIG. 1 | 45 | 1.0 | 390 | 205800 | 25 | 1000 | 22 | 2 | 0.023 | 13.8 | 85.6 | 20.0 | No | 15.1 | No | Inv. ex. |
| | | | | | | | | 14 | | 0.023 | 13.8 | 85.6 | 12.0 | | 16.4 | No | Comp. ex. |
| | | | | | | | | 90 | | 0.023 | 13.8 | 85.6 | 88.0 | | 16.6 | No | Comp. ex. |
| | | | | | | | | — | | — | — | — | — | | 16.9 | No | Prior ex. |
| 1-10 | FIG. 1 | 45 | 1.0 | 590 | 205800 | 25 | 80 | 22 | 2 | 0.023 | 15.3 | 75.1 | 20.0 | No | 10.1 | No | Inv. ex. |
| | | | | | | | to | 22 | | 0.015 | 15.3 | 59.2 | 20.0 | | 10.0 | No | Inv. ex. |
| | | | | | | | 1200 | 22 | | 0.040 | 15.3 | 88.0 | 20.0 | | 16.8 | Yes | Comp. ex. |
| | | | | | | | | 17 | | 0.023 | 15.3 | 75.1 | 15.0 | | 16.3 | No | Comp. ex. |
| | | | | | | | | 90 | | 0.023 | 15.3 | 75.1 | 88.0 | | 16.7 | No | Comp. ex. |
| | | | | | | | | — | | 0.023 | — | — | — | | 17.1 | No | Prior ex. |
| 1-11 | FIG. 1 | 45 | 1.0 | 590 | 205800 | 25 | 1000 | 21 | 4 | 0.023 | 15.7 | 84.8 | 17.0 | No | 11.3 | No | Inv. ex. |
| | | | | | | | | 15 | | 0.023 | 15.7 | 84.8 | 11.0 | | 18.3 | No | Comp. ex. |
| | | | | | | | | 90 | | 0.023 | 15.7 | 84.8 | 86.0 | | 18.7 | No | Comp. ex. |
| | | | | | | | | — | | 0.023 | — | — | — | | 19.1 | No | Prior ex. |
| | | | | | | | | 25 | 8 | 0.023 | 12.9 | 81.2 | 17.0 | | 12.4 | No | Inv. ex. |
| | | | | | | | | 19 | | 0.023 | 12.9 | 81.2 | 11.0 | | 20.0 | No | Comp. ex. |
| | | | | | | | | 90 | | 0.023 | 12.9 | 81.2 | 82.0 | | 20.5 | No | Comp. ex. |
| | | | | | | | | — | | 0.023 | — | — | — | | 20.9 | No | Prior ex. |
| 1-12 | FIG. 1 | 45 | 1.0 | 590 | 205800 | 10 | 1000 | 32 | 2 | 0.023 | 29.0 | 88.0 | 30.0 | No | 9.5 | No | Inv. ex. |
| | | | | | | | | 27 | | 0.023 | 29.0 | 88.0 | 25.0 | | 15.3 | No | Comp. ex. |

TABLE 1-continued

| Exp. level | Final shaped article shape | W (mm) | Sheet thickness (mm) | Tensile strength $\sigma_Y$ (MPa) | Young's modulus E (MPa) | b (mm) | $R_0$ (mm) | $\alpha_1$ (°) | $\alpha_2$ (°) | εcr (—) | Range able to be taken by β Min. (°) | Max. (°) | β (°) | Pad use | Am't of warping and torsion (mm) | Wrinkles | Remarks |
|---|---|---|---|---|---|---|---|---|---|---|---|---|---|---|---|---|---|
| | | | | | | | | — | | 0.023 | — | — | — | | 16.0 | No | Prior ex. |
| 1-13 | FIG. 1 | 45 | 1.0 | 590 | 205800 | 35 | 1000 | 19 | 2 | 0.023 | 14.3 | 70.0 | 17.0 | No | 13.5 | No | Inv. ex. |
| | | | | | | | | 13 | | 0.023 | 14.3 | 70.0 | 11.0 | | 21.8 | No | Comp. ex. |
| | | | | | | | | 82 | | 0.023 | 14.3 | 70.0 | 80.0 | | 22.3 | No | Comp. ex. |
| | | | | | | | | — | | 0.023 | — | — | — | | 22.8 | No | Prior ex. |
| 1-14 | Based on FIG. 11a | 30 | 1.0 | 590 | 205800 | 25 | 30 | 4 | 2 | 0.023 | 0.4 | 4.1 | 2.0 | No | 12.8 | No | Inv. ex. |
| | | | | | | | | 2.2 | | 0.023 | 0.4 | 4.1 | 0.2 | | 20.6 | No | Comp. ex. |
| | | | | | | | | 12 | | 0.023 | 0.4 | 4.1 | 10.0 | | 21.1 | No | Comp. ex. |
| | | | | | | | | — | | 0.023 | — | — | — | | 21.6 | No | Prior ex. |
| 1-15 | FIG. 11a | 30 | 1.0 | 590 | 205800 | 25 | 300 | 22 | 2 | 0.023 | 8.4 | 41.6 | 20.0 | No | 7.1 | No | Inv. ex. |
| | | | | | | | | 8 | | 0.023 | 8.4 | 41.6 | 6.0 | | 11.4 | No | Comp. ex. |
| | | | | | | | | 52 | | 0.023 | 8.4 | 41.6 | 50.0 | | 11.6 | No | Comp. ex. |
| | | | | | | | | — | | 0.023 | — | — | — | | 11.9 | No | Prior ex. |
| 1-16 | FIG. 11b | 30 | 1.0 | 590 | 205800 | 25 | 500 | 22 | 2 | 0.023 | 11.6 | 56.4 | 20.0 | No | 8.2 | No | Inv. ex. |
| | | | | | | | | 10 | | 0.023 | 11.6 | 56.4 | 8.0 | | 13.2 | No | Comp. ex. |
| | | | | | | | | 62 | | 0.023 | 11.6 | 56.4 | 60.0 | | 13.5 | No | Comp. ex. |
| | | | | | | | | — | | 0.023 | — | — | — | | 13.8 | No | Prior ex. |
| 1-17 | FIG. 11c | 30 | 1.0 | 590 | 205800 | 25 | 700 | 22 | 2 | 0.023 | 14.1 | 69.1 | 20.0 | No | 9.3 | No | Inv. ex. |
| | | | | | | | | 12 | | 0.023 | 14.1 | 69.1 | 10.0 | | 14.9 | No | Comp. ex. |
| | | | | | | | | 77 | | 0.023 | 14.1 | 69.1 | 75.0 | | 15.3 | No | Comp. ex. |
| | | | | | | | | — | | 0.023 | — | — | — | | 15.6 | No | Prior ex. |
| 1-18 | FIG. 11d | 30 | 1.0 | 590 | 205800 | 25 | 900 | 22 | 2 | 0.023 | 16.4 | 80.9 | 20.0 | No | 10.4 | No | Inv. ex. |
| | | | | | | | | 17 | | 0.023 | 16.4 | 80.9 | 15.0 | | 16.8 | No | Comp. ex. |
| | | | | | | | | 84 | | 0.023 | 16.4 | 80.9 | 82.0 | | 17.2 | No | Comp. ex. |
| | | | | | | | | — | | 0.023 | — | — | — | | 17.6 | No | Prior ex. |
| 1-19 | FIG. 11e | 30 | 1.0 | 590 | 205800 | 25 | 1000 | 22 | 2 | 0.023 | 17.4 | 86.7 | 20.0 | No | 11.0 | No | Inv. ex. |
| | | | | | | | | 17 | | 0.023 | 17.4 | 86.7 | 15.0 | | 17.7 | No | Comp. ex. |
| | | | | | | | | 89 | | 0.023 | 17.4 | 86.7 | 87.0 | | 18.2 | No | Comp. ex. |
| | | | | | | | | — | | 0.023 | — | — | — | | 18.6 | No | Prior ex. |
| 1-20 | FIG. 11f | 30 | 1.0 | 590 | 205800 | 25 | 1100 | 22 | 2 | 0.023 | 18.3. | 88.0 | 20.0 | No | 11.7 | No | Inv. ex. |
| | | | | | | | | 17 | | 0.023 | 18.3 | 88.0 | 15.0 | | 18.8 | No | Comp. ex. |
| | | | | | | | | — | | 0.023 | — | — | — | | 19.7 | No | Prior ex. |
| 1-21 | FIG. 11g | 30 | 1.0 | 590 | 205800 | 25 | 1300 | 27 | 2 | 0.023 | 20.2 | 88.0 | 25.0 | No | 13.0 | No | Inv. ex. |
| | | | | | | | | 17 | | 0.023 | 20.2 | 88.0 | 15.0 | | 21.0 | No | Comp. ex. |
| | | | | | | | | — | | 0.023 | — | — | — | | 21.9 | No | Prior ex. |
| 1-22 | FIG. 11h | 30 | 1.0 | 590 | 205800 | 25 | 1500 | 27 | 2 | 0.023 | 21.8 | 88.0 | 25.0 | No | 14.2 | No | Inv. ex. |
| | | | | | | | | 20 | | 0.023 | 21.8 | 88.0 | 18.0 | | 22.9 | No | Comp. ex. |
| | | | | | | | | — | | 0.023 | — | — | — | | 24.0 | No | Prior ex. |
| 1-23 | FIG. 11i | 30 | 1.0 | 590 | 205800 | 25 | 1700 | 27 | 2 | 0.023 | 23.4 | 88.0 | 25.0 | No | 15.5 | No | Inv. ex. |
| | | | | | | | | 22 | | 0.023 | 23.4 | 88.0 | 20.0 | | 24.9 | No | Comp. ex. |
| | | | | | | | | — | | 0.023 | — | — | — | | 26.0 | No | Prior ex. |
| 1-24 | Based on FIG. 11i | 30 | 1.0 | 590 | 205800 | 25 | 2100 | 42 | 2 | 0.023 | 26.3 | 88.0 | 40.0 | No | 16.8 | No | Inv. ex. |
| | | | | | | | | 22 | | 0.023 | 26.3 | 88.0 | 20.0 | | 27.1 | No | Comp. ex. |
| | | | | | | | | — | | 0.023 | — | — | — | | 28.3 | No | Prior ex. |

As clear from Table 1, it was confirmed that by making the additional bending angle β the range of the present invention, even when shaping 440 to 1600 MPa high strength steel sheet into the final shaped articles 1 which are shown in FIG. 1, FIG. 3, and FIGS. 11*a* to 11*b*, the amounts of warping and torsion become similar to the case of shaping tensile strength 390 MPa soft steel sheet and that no wrinkles form at the inside flange parts 4*a*, 4-1*a*, and 4-1*b*. Note that, as a factor affecting the amount of warping and torsion, the additional bending angle β is large in effect. In the range of β of the present invention, it was confirmed that the amount of warping and torsion can be suppressed to 17 mm or less. Further, it was confirmed that the invention examples enable the amount of warping and torsion to be greatly reduced compared to the prior art examples which do not use two stages for shaping like in the present invention but use one shaping operation to obtain a final shaped article 1.

In particular, it was confirmed that when W is 15 to 30 mm, use of the pads 55*a*, 55*b* is particularly effective.

On the other hand, when the additional bending angle β is below the lower limit of the present invention, it was confirmed that a larger amount of warping and torsion occurs than even when shaping 440 MPa strength soft steel sheet.

Further, when the additional bending angle β is above the upper limit of the present invention, it was confirmed that a similar amount of warping and torsion occurs as when shaping 440 MPa strength soft steel sheet, but wrinkles form at the inside flange parts 4*a*, 4-1*a*, and 4-1*b*.

Example 2

A roof rail outer reinforcement of a frame part of an automobile chassis is shown in FIG. 7. This part, as shown in FIG. 7, has a shape which is gently curved in the longitudinal direction (shape with curvature continuously changing from minimum radius 700 mm to maximum radius 1200 mm).

If press-forming a roof rail outer reinforcement which is curved in the longitudinal direction, when forming the vertical wall part 3*a*, warping and torsion occur due to the moment in the sheet thickness direction which occurs at the top sheet surface 2 and the tensile stress which occurs when shaping the inside flange part 4*a*.

Therefore, the inventors used sheet high strength steel sheet with a thickness of 1.0 mm and a tensile strength of 980 MPa to perform the above-mentioned first shaping process and second shaping process. Experiment Level 2-1 is a prior art example which does not use two stages for shaping like in the present invention, but uses one shaping operation to obtain the final shaped article 1. Experiment Level 2-2 is an invention example which performs the first shaping process and second shaping process of the present invention. The results of measurement of springback of the front end part (amount of warping and torsion) are shown in Table 2. Note that the amount of warping and torsion was evaluated by the method based on Example 1.

TABLE 2

| Exp. level | Final shaped article shape | W (mm) | Sheet thickness (mm) | Tensile strength $\sigma_Y$ (MPa) | Young's modulus E (MPa) | b (mm) | $R_0$ (mm) | $\alpha_1$ (°) | $\alpha_2$ (°) | εcr (—) | Range able to be taken by β Min. (°) | Range able to be taken by β Max. (°) | β (°) | Pad use | Am't of warping and torsion (mm) | Wrinkles | Remarks |
|---|---|---|---|---|---|---|---|---|---|---|---|---|---|---|---|---|---|
| 2-1 | FIG. 7 | 30 | 1.0 | 980 | 205800 | 25 | 700 | — | 2 | — | — | — | — | Yes | 12.5 | No | Prior ex. |
| 2-2 | FIG. 7 | 30 | 1.0 | | | | to 1200 | 27 | | 0.023 | 18.8 | 70.8 | 25.0 | Yes | 2.73 | No | Inv. ex. |

The prior art example of Experiment Level 2-1 suffered from large warping and torsion. As opposed to this, the invention example of Experiment Level 2-2 applied the first shaping process and second shaping process and therefore could be confirmed to be suppressed in warping and torsion.

Example 3

Figure 8:
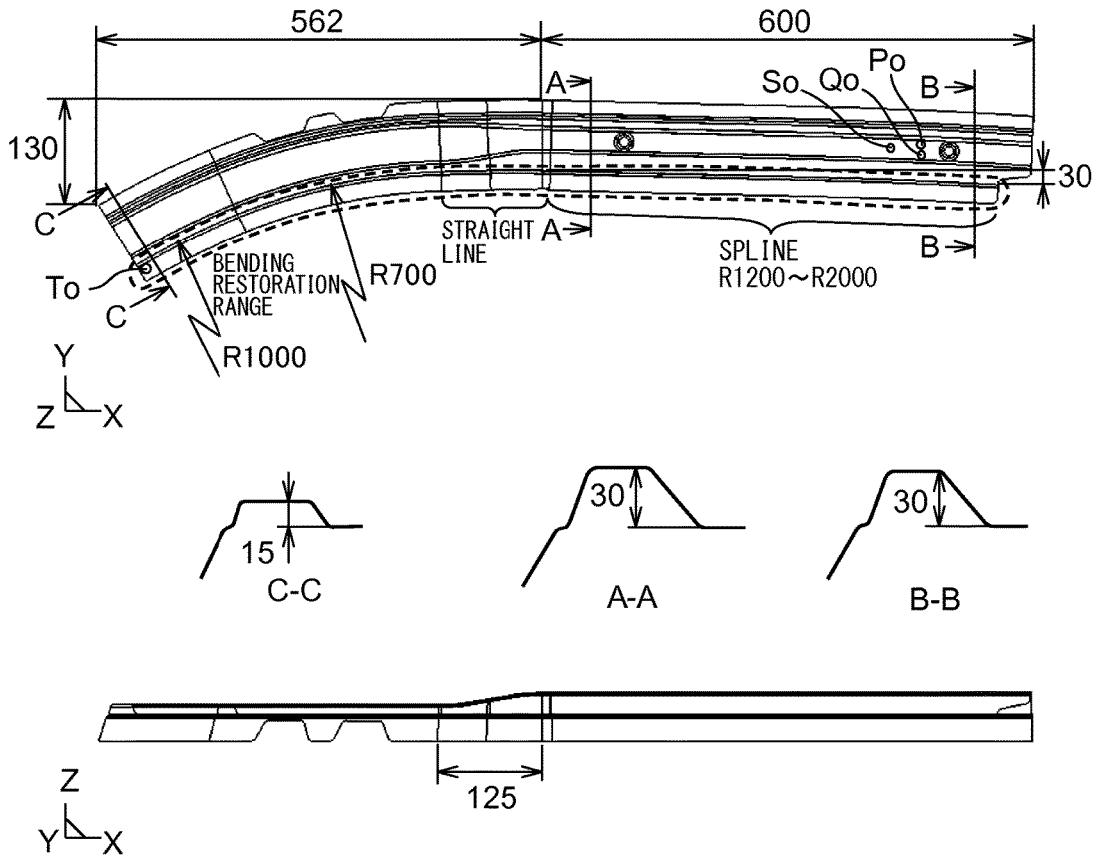
FIG. 8 is a view which shows a final shaped article which has a bent parts with radii of curvature of 1000 mm and 700 mm and has a straight part, which further combines a shape with a radius of curvature which continuously changes in 1200 to 2000 mm in range, and which gently curves in the longitudinal direction when seen from a top view.
Figure 9:
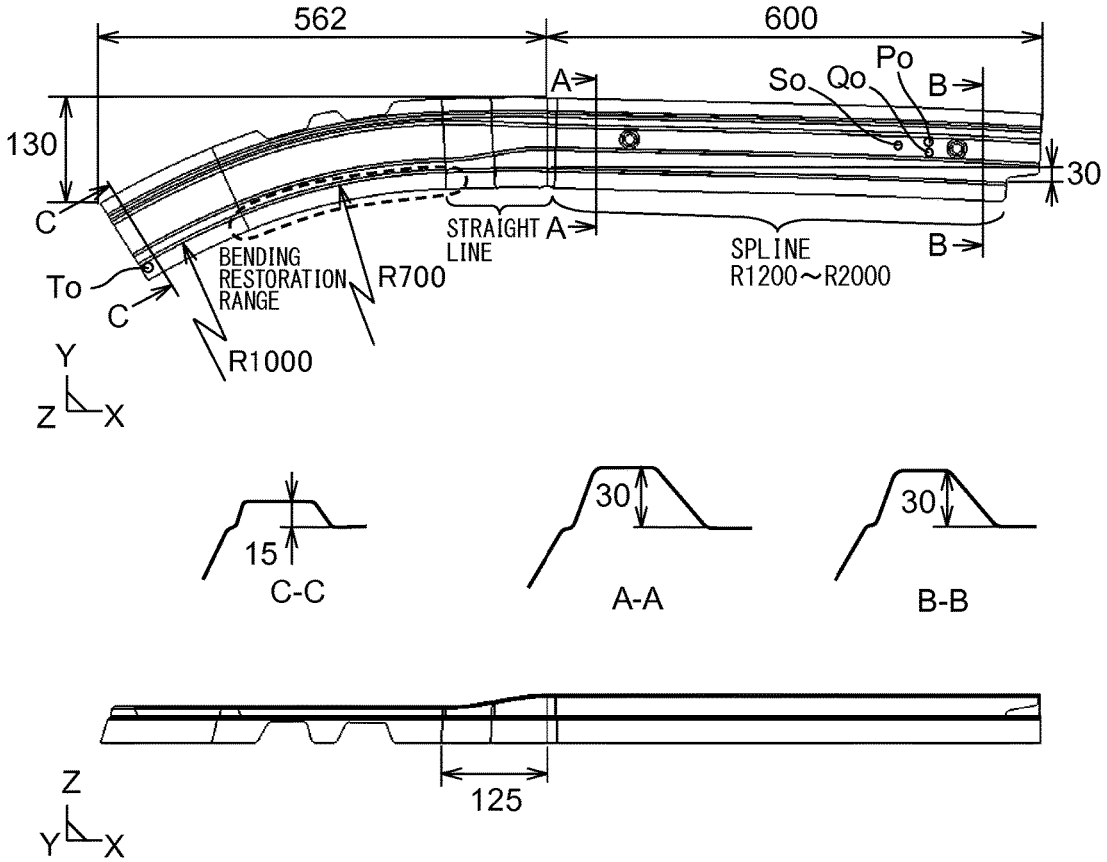
FIG. 9 is a view which shows a final shaped article which has bent parts with radii of curvature of 1000 mm and 700 mm and has a straight part, which further combines a shape with a radius of curvature which continuously changes in 1200 to 2000 mm in range, and which gently curves in the longitudinal direction when seen from a top view. Note that, the range of additional bending is part of the inside flange.

In an actual part, as shown in the above-mentioned FIG. 8, there are cutaway parts. Further, there are joint seats, bead shapes, etc. which are used when assembling parts using welding, bolts, etc. This is to avoid interference with other parts at the time of assembly at a location which is curved in the longitudinal direction. Alternatively, this is for improving the strength etc.

If press-forming a part which is curved in the longitudinal direction, when forming the vertical wall parts 3*a*, warping and torsion occur due to the moment in the sheet thickness direction of the steel sheet which occurs at the top sheet surface 2 and the tensile stress which occurs when shaping the inside flange part 4*a*.

Therefore, high strength steel sheet with a sheet thickness of 1.0 mm and a tensile strength of 980 MPa was shaped by the above-mentioned first shaping process and second shaping process. Experiment Level 3-1 is a comparative example which does not use two stages for shaping like the present invention but uses one shaping operation to obtain the final shaped article 1. Experiment Level 3-2 is an invention example which shapes the inside flange part in the range which is shown by the broken lines in FIG. 8 by the first shaping process and second shaping process of the present invention. The results of measurement of the amount of warping and torsion of the final shaped article 1 are shown in Table 3. Note that, the amount of warping and torsion was evaluated by a method based on Example 1.

TABLE 3

| Exp. level | Final shaped article shape | W (mm) | Sheet thickness (mm) | Tensile strength $\sigma_Y$ (MPa) | Young's modulus E (MPa) | b (mm) | $R_0$ (mm) | $\alpha_1$ (°) | $\alpha_2$ (°) | εcr (—) | Range able to be taken by β Min. (°) | Range able to be taken by β Max. (°) | β (°) | Pad use | Am't of warping and torsion (mm) | Wrinkles | Remarks |
|---|---|---|---|---|---|---|---|---|---|---|---|---|---|---|---|---|---|
| 3-1 | FIG. 8 | 30 | 1.0 | 980 | 205800 | 25 | 700 | — | 2 | — | — | — | — | Yes | 8.92 | No | Comp. ex. |
| 3-2 | FIG. 8 | 30 | 1.0 | | | | | 24 | | 0.023 | 18.8 | 70.8 | 22.0 | Yes | 2.48 | No | Inv. ex. |

The comparative example of Experiment Level 3-1 suffered from large warping and torsion. As opposed to this, the invention example of Experiment Level 3-2 applied the first shaping process and second shaping process and therefore could be confirmed to be suppressed in warping and torsion.

Example 4

The range of additional bending at the inside flange may also be partial. Therefore, the invention example of Experiment Level 4-2 shaped the inside flange part in the range which is shown by the broken lines in FIG. 9 by the first shaping process and second shaping process of the present invention. The results of measurement of the amount of warping and torsion of the final shaped article 1 are shown in Table 4. Note that, the amount of warping and torsion was evaluated by a method based on Example 1. Further, as Experiment Level 4-1, a comparative example which does not use two stages for shaping like in the present invention but uses one shaping operation to obtain the final shaped article 1 was prepared and evaluated.

TABLE 4

| Exp. level | Final shaped article shape | W (mm) | Sheet thickness (mm) | Tensile strength $\sigma_Y$ (MPa) | Young's modulus E (MPa) | b (mm) | $R_0$ (mm) | $\alpha_1$ (°) | $\alpha_2$ (°) | εcr (—) | Range able to be taken by β Min. (°) | Range able to be taken by β Max. (°) | β (°) | Pad use | Am't of warping and torsion (mm) | Wrinkles | Remarks |
|---|---|---|---|---|---|---|---|---|---|---|---|---|---|---|---|---|---|
| 4-1 | FIG. 9 | 30 | 1.0 | 980 | 205800 | 25 | 700 | — | 2 | — | — | — | — | Yes | 11.5 | No | Comp. ex. |
| 4-2 | FIG. 9 | 30 | 1.0 | | | | | 22 | | 0.023 | 18.8 | 70.8 | 20.0 | Yes | 2.96 | No | Inv. ex. |

The invention example of Experiment Level 4-2 applied the first shaping process and second shaping process and therefore could be confirmed to be suppressed in warping and torsion. As opposed to this, the comparative example of Experiment Level 4-1 suffered from great warping and torsion.

Example 5

Figure 10:
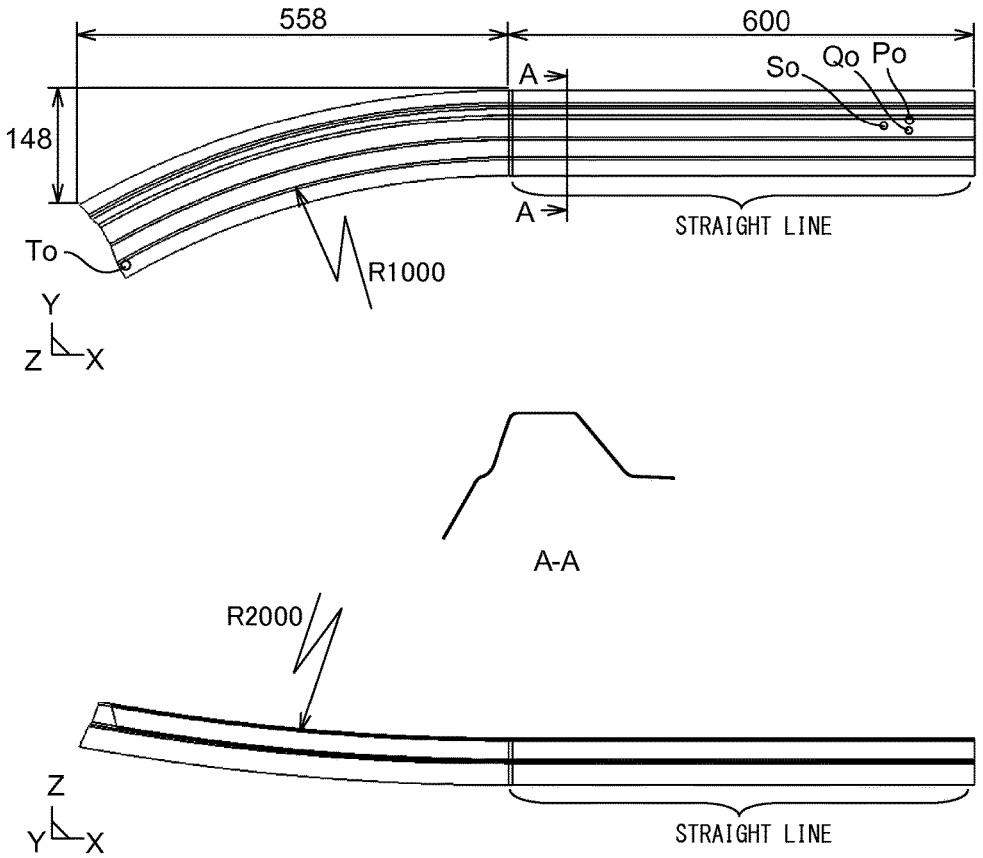
FIG. 10 is a view which shows a final shaped article which has a bent part with a radius of curvature of 1000 mm and has a straight part, which further a bent part with a radius of curvature of 3000 mm and a straight part in the direction seen from the side surface, and which gently curves in the longitudinal direction when seen from a top view.
Figure 11:
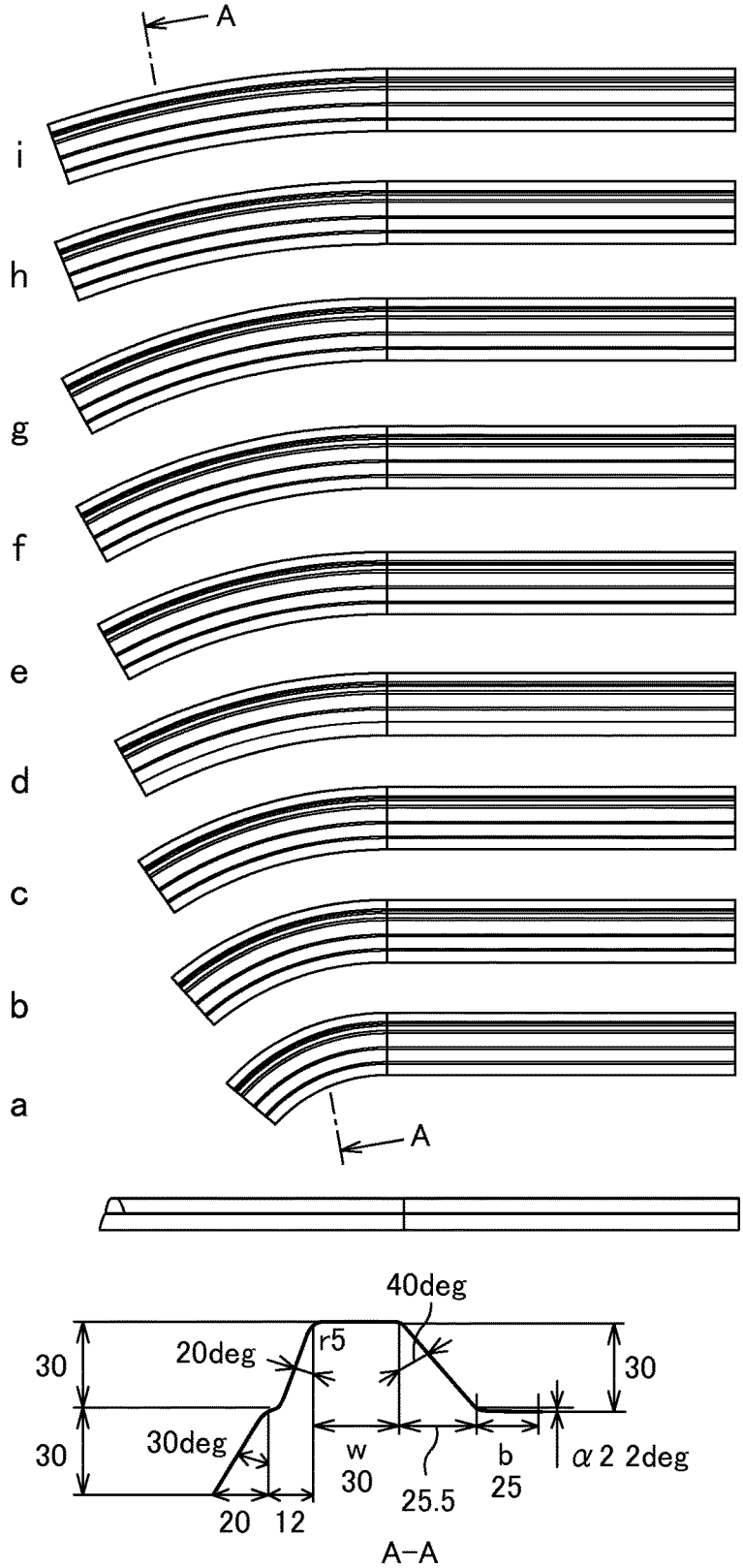
FIG. 11 is a view which shows one example of a final shaped article which has one bent part.

One part of a roof rail outer reinforcement of a frame part of an automobile chassis is shown in FIG. 10. If press-forming the roof rail outer reinforcement which is curved in the longitudinal direction, when forming the vertical wall parts, warping and torsion occur due to the moment of the sheet thickness of the steel sheet which occurs at the top sheet surface and the tensile stress which occurs when shaping the inside flange part.

Therefore, high strength steel sheet with a sheet thickness of 1.0 mm and a tensile strength of the 980 MPa class was subjected to the above-mentioned first shaping process and second shaping process. Experiment Level 5-1 is a comparative example which does not use two stages for shaping like in the present invention but uses one shaping operation to obtain the final shaped article 1. Experiment Level 5-2 is an invention example which applied the first shaping process and second shaping process of the present invention. The results of measurement of the amount of warping and torsion are shown in Table 5. Note that, the amount of warping and torsion was evaluated by a method which is based on Example 1.

TABLE 5

| Exp. level | Final shaped article shape | W (mm) | Sheet thickness (mm) | Tensile strength $\sigma_Y$ (MPa) | Young's modulus E (MPa) | b (mm) | $R_0$ (mm) | $\alpha_1$ (°) | $\alpha_2$ (°) | εcr (—) | Range able to be taken by β Min. (°) | Range able to be taken by β Max. (°) | β (°) | Pad use | Am't of warping and torsion (mm) | Wrinkles | Remarks |
|---|---|---|---|---|---|---|---|---|---|---|---|---|---|---|---|---|---|
| 5-1 | FIG. 10 | 30 | 1.0 | 980 | 205800 | 25 | 1000 | — | 2 | — | — | — | — | Yes | 14.7 | No | Comp. ex. |
| 5-2 | FIG. 10 | 30 | 1.0 | | | | to 3000 | 36 | | 0.023 | 23.0 | 88.0 | 34.0 | Yes | 6.66 | No | Inv. ex. |

The comparative example of Experiment Level 5-1 has a large warping and torsion. As opposed to this, the invention example of Experiment Level 5-2 applied the first shaping process and second shaping process and therefore could be confirmed to be suppressed in warping and torsion.

INDUSTRIAL APPLICABILITY

As explained above, according to the present invention, it is possible to provide a final shaped article 1 which comprises a top sheet part, vertical wall parts, and flange parts and which has at least one bent part with a minimum radius of curvature of 50 to 2000 mm in the longitudinal direction wherein warping and torsion can be suppressed. Therefore, it is possible to reduce poor dimensional accuracy of the final shaped article. Accordingly, the present invention has high value of utilization in industry.

REFERENCE SIGNS LIST

1. final shaped article
2. top sheet part
3*a*, 3-1*a*, 3-2*a*. inside vertical wall part
3*b*, 3-1*b*, 3-2*b*. outside vertical wall part
4*a*, 4-1*a*, 4-2*a*. inside flange part
4*b*, 4-1*b*, 4-2*b*. outside flange part
5*a*, 5-1*a*, 5-2*a*. inside intersecting part
5*b*, 5-1*b*, 5-2*b*. outside intersecting part
10, 10-1, 10-2. bent part
10*a*, 10-1*a*, 10-2*a*. inside bent part
10*b*, 10-1*b*, 10-2*b*. outside bent part
30. main part
31. branched part
50. first die
60. second die
52, 62. top sheet part shaping surface
53*a*, 63*a*. inside vertical wall part shaping surface
53*b*, 63*b*. outside vertical wall part shaping surface
54*a*, 64*a*. inside flange part shaping surface
54*b*, 64*b*. outside flange part shaping surface
55*a*, 55*b*. pad
56*a*, 56*b* partial shaping die
80. press machine
81. small-sized hydraulic cylinder
90. steel sheet material
92. portion forming top sheet part at final shaped article
H. horizontal line
$P_0$, $Q_0$, $S_0$, $T_0$. position measurement points of final shaped article

The invention claimed is:

1. A press-forming method for press-forming a final shaped article comprising a top sheet part, a vertical wall part, and a flange part and having at least one bent part in a longitudinal direction, the method comprising:

a first shaping process comprising:

bending a high strength steel sheet with a tensile strength of 440 to 1600 MPa to form the top sheet part, the vertical wall part, the at least one bent part, and the flange part, the flange part being bent at an intersecting part until an angle of the flange part with a horizontal line becomes $\alpha_1$ in a plane which includes a horizontal line which connects an intersecting part of the vertical wall part and the one of the flange part and a center of curvature of the at least one bent part and which is vertical to said high strength steel sheet when forming the top sheet part, the vertical wall part, the at least one bent part, and the flange parts, and a second shaping process comprising:

bending the flange part after the first shaping process at the intersecting part until the angle of the flange part with the horizontal line becomes $\alpha_2$ in that plane, and wherein when the radius of curvature of the at least one bent part in said plane is $R_0$ (mm), the length of the flange part is "b" (mm), the numerical value which shows the allowable value of strain is $\epsilon cr$, and the Young's modulus and tensile strength of said high strength steel sheet are E (MPa) and $\sigma_T$ (MPa), for $\alpha_1$ and $\alpha_2$, a direction of rotation starting from said horizontal line in the direction where the flange part moves away from the top sheet part is made positive, and $\alpha_1>0$, $\alpha_2\geq 0$, $\alpha_1-\alpha_2>0$, $R_0=50$ to 2000 mm, and $\epsilon cr=0$ to 0.023, $\alpha_1-\alpha_2$, defined as an additional bending angle $\beta$, is formed to satisfy the following ranges:

When Mathematical Formula 1

$$\cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]\leqq 90^\circ$$

$$\cos^{-1}\left[\frac{b\cos\alpha_2-\left(\frac{0.5\sigma_T}{E}\right)R_0}{b\left\{1-\left(\frac{0.5\sigma_T}{E}\right)\right\}}\right]-\alpha_2\leqq\beta\leqq$$

$$\cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]-\alpha_2$$

and

When Mathematical Formula 2

$$\cos^{-1}\left[\frac{b\cos\alpha_2-\left(\frac{0.5\sigma_T}{E}+\varepsilon cr\right)R_0}{b\left\{1-\left(\frac{0.5\sigma_T}{E}+\varepsilon cr\right)\right\}}\right]>90^\circ$$

$$\cos^{-1}\left[\frac{b\cos\alpha_2-\left(\frac{0.5\sigma_T}{E}\right)R_0}{b\left\{1-\left(\frac{0.5\sigma_T}{E}\right)\right\}}\right]-\alpha_2\leqq$$

$$\beta\leqq 90^\circ-\alpha_2.$$

2. The press-forming method according to claim 1 wherein said at least one bent part is an arc or a curve with a curvature which continuously changes.

3. The press-forming method according to claim 1 wherein at least at one of said first shaping process and said second shaping process is performed using one of a plurality of facing dies divided into a pad and a partial shaping die, the pad and the other of said plurality of facing dies press the steel sheet, and the partial shaping die and the other of said plurality of facing dies are used to make the steel sheet plastically deform.

4. The press-forming method according to claim 2 wherein at least at one of said first shaping process and said second shaping process is performed using one of a plurality of facing dies divided into a pad and a partial shaping die, the pad and the other of said plurality of facing dies press the steel sheet, and the partial shaping die and the other of said plurality of facing dies are used to make the steel sheet plastically deform.

* * * * *